US009215956B2

(12) United States Patent
Ryu

(10) Patent No.: US 9,215,956 B2
(45) **Date of Patent: *Dec. 22, 2015**

(54) GLASS WINDOW CLEANING DEVICE AND A CONTROL METHOD THEREFOR

(75) Inventor: Man Hyun Ryu, Gyeongbuk (KR)

(73) Assignees: INTELLECTUAL DISCOVERY CO., LTD., Seoul (KR); KOREA INSTITUTE OF ROBOT & CONVERGENCE, Pohang (KR)

( * ) Notice: Subject to any disclaimer, the term of this patent is extended or adjusted under 35 U.S.C. 154(b) by 642 days.

This patent is subject to a terminal disclaimer.

(21) Appl. No.: 13/386,016

(22) PCT Filed: Nov. 4, 2010

(86) PCT No.: PCT/KR2010/007761

§ 371 (c)(1),
(2), (4) Date: Jan. 19, 2012

(87) PCT Pub. No.: WO2011/126193

PCT Pub. Date: Oct. 13, 2011

(65) Prior Publication Data

US 2013/0014782 A1 Jan. 17, 2013

(30) Foreign Application Priority Data

| | | |
|---|---|---|
| Apr. 9, 2010 | (KR) | 10-2010-0032786 |
| May 15, 2010 | (KR) | 10-2010-0045717 |
| May 15, 2010 | (KR) | 10-2010-0045718 |

(51) Int. Cl.

| | |
|---|---|
| ***A47L 1/03*** | (2006.01) |
| ***A47L 1/12*** | (2006.01) |
| *A47L 1/02* | (2006.01) |

(52) U.S. Cl.
CPC ... *A47L 1/03* (2013.01); *A47L 1/12* (2013.01); *A47L 1/02* (2013.01)

(58) Field of Classification Search
None
See application file for complete search history.

(56) References Cited

U.S. PATENT DOCUMENTS

| | | | | |
|---|---|---|---|---|
| 5,216,775 | A | 6/1993 | Takasaki | |
| 2004/0216253 | A1* | 11/2004 | Enoch et al. | 15/103 |
| 2007/0251036 | A1 | 11/2007 | Remer | |
| 2009/0106925 | A1 | 4/2009 | Cheyne | |
| 2011/0308547 | A1* | 12/2011 | Chao | 134/18 |

FOREIGN PATENT DOCUMENTS

| | | | |
|---|---|---|---|
| CN | 2131441 | Y | 5/1993 |
| CN | 2684747 | Y | 3/2005 |
| JP | 05-9453 | | 2/1993 |
| JP | 06-062984 | A | 3/1994 |
| JP | 2001-346723 | A | 12/2001 |
| JP | 2004-212382 | A | 7/2004 |
| JP | 2005-080973 | | 3/2005 |
| JP | 2007-156884 | A | 6/2007 |

(Continued)

*Primary Examiner* — Michael Kornakov
*Assistant Examiner* — Ryan Coleman

(57) ABSTRACT

Provided are a window cleaning apparatus and a method of controlling the same. The window cleaning apparatus including first and second cleaning units which are respectively attached on both surfaces of a window using a magnetic force to move together with each other includes a first magnetic module provided in the first cleaning unit, a second magnetic module provided in the second cleaning unit, a magnetic force detection part for detecting a magnetic force between the first and second magnetic modules, and a magnetic force control part for controlling the magnetic force between the first and second magnetic modules.

11 Claims, 33 Drawing Sheets

(56) References Cited

FOREIGN PATENT DOCUMENTS

| | | | |
|---|---|---|---|
| JP | 2009-219831 | A | 10/2009 |
| KR | 10-1997-0063604 | | 9/1997 |
| KR | 20-0312929 | | 5/2003 |
| KR | 1020060084422 | | 7/2006 |
| KR | 100743467 | B1 | 7/2007 |
| KR | 20-0438170 | | 1/2008 |
| KR | 10-0845742 | B1 | 7/2008 |
| WO | 2006078921 | A1 | 7/2006 |
| WO | 2009093860 | A2 | 7/2009 |

* cited by examiner (a)

(b)

GLASS WINDOW CLEANING DEVICE AND A CONTROL METHOD THEREFOR

CROSS-REFERENCE TO RELATED APPLICATIONS

The present application claims priority under 35 U.S.C. 119 and 35 U.S.C. 365 to PCT Patent Application No. PCT/KR2010/007761 (filed on 4 Nov. 2010), Korean Patent Application No. 10-2010-0032786 (filed on 9 Apr. 2010), No. 10-2010-0045717 (filed on 15 May, 2010), No. 10-2010-0045718 (filed on 15 May 2010) which is hereby incorporated by reference in its entirety.

BACKGROUND

The present disclosure relates to a window cleaning apparatus.

Windows installed on a wall of a building are easily polluted by external dust and pollutants, which may degrade their appearance and lighting performance. Thus, such windows are frequently cleaned.

However, the outer surface of a window is more difficult to clean than the inner surface thereof. Particularly, as the height of buildings increases, cleaning of the outer surface of a window may involve great risks.

SUMMARY

Embodiments provide a window cleaning apparatus that efficiently operates with improved safety, and a method of controlling a movement thereof.

In one embodiment, a window cleaning apparatus including first and second cleaning units which are respectively attached on both surfaces of a window using a magnetic force to move together with each other includes: a first magnetic module provided in the first cleaning unit; a second magnetic module provided in the second cleaning unit; a magnetic force detection part for detecting a magnetic force between the first and second magnetic modules; and a magnetic force control part for controlling the magnetic force between the first and second magnetic modules.

In another embodiment, a method of controlling a window cleaning apparatus including first and second cleaning units which are respectively attached on both surfaces of a window using a magnetic force to move together with each other includes: detecting a magnetic force between first and second magnetic modules which are respectively disposed on the first and second cleaning units; comparing the detected magnetic force to a reference value; and controlling the magnetic force between the first and second magnetic modules according to the comparison result.

The control method may be realized through a computer readable recording medium which records a program for executing the method in a computer.

The details of one or more embodiments are set forth in the accompanying drawings and the description below. Other features will be apparent from the description and drawings, and from the claims.

DETAILED DESCRIPTION OF THE EMBODIMENTS

Figure 1:
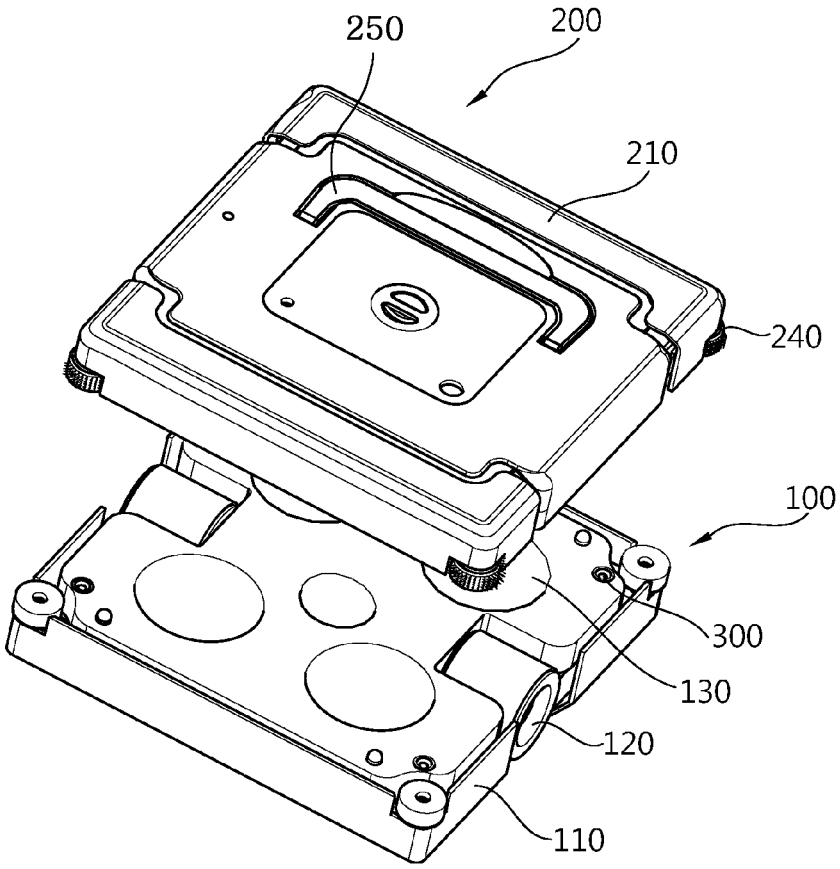
FIG. 1 is a perspective view of a window cleaning apparatus according to an embodiment.

Hereinafter, embodiments will be described with reference to the accompanying drawings. The present disclosure may, however, be embodied in different forms and should not be constructed as limited to the embodiments set forth herein. Rather, these embodiments are provided so that this disclosure will be thorough and complete, and will fully convey the scope of the present disclosure to those skilled in the art. Thus, in the drawings, the shapes and sizes of elements are exaggerated for clarity.

FIG. 1 is a perspective view of a window cleaning apparatus according to an embodiment. Referring to FIG. 1, a window cleaning apparatus according to the current embodiment may include a first cleaning unit 100 and a second cleaning unit 200, which are disposed on both surfaces of a window, respectively.

The first cleaning unit 100 may be disposed on the inner surface of both surfaces of the window, and the second cleaning unit 200 may be disposed on the outer surface of the window. On the contrary, as necessary, the first cleaning unit 100 may be disposed on the outer surface of both surfaces of the window, and the second cleaning unit 200 may be disposed on the inner surface of the window.

The first and second cleaning units 100 and 200 may be attached on both surfaces of the window using magnetic modules respectively provided therein to face each other.

When the first cleaning unit 100 is moved while the first cleaning unit 100 is attached to the inner surface of a window by an external or internal power source, the second cleaning unit 200 may be moved together with the first cleaning unit 100 by a magnetic force between the magnetic modules of the first and second cleaning units 100 and 200.

The second cleaning unit 200 may include a handle 250 as an attachment/detachment member 250 for easily attaching or detaching the second cleaning unit 200 to or from a window. Also, the first cleaning unit 100 may include an attachment/detachment member (not shown) corresponding to the attachment/detachment member 250 to easily attach and detach the first cleaning unit 100.

Thus, a user may attach the window cleaning apparatus to a window by using the attachment/detachment members of the first and second cleaning units 100 and 200, i.e., by using the handles, and detach the first and second cleaning units 100 and 200 from the window by using the handles after the cleaning is completed.

The window cleaning apparatus may further include a remote controller (not shown) for allowing a user to control the first and second cleaning units 100 and 200.

As described above, the second cleaning unit 200 is passively moved by the magnetic force according to a movement of the first cleaning unit 100. The user may control the movement of the first cleaning unit 100 through the remote controller to control an operation of the window cleaning apparatus including the first and second cleaning units 100 and 200.

Although a wireless type remote controller is exemplified in the current embodiment, a wire type remote controller may be used, or the window cleaning apparatus may be manually manipulated by the user.

The window cleaning apparatus, more particularly, the first cleaning unit 100 disposed on the inner surface of the window may be moved along a preset moving path, or may include a sensor (not shown) for detecting dusts to move along a moving path for improving cleaning efficiency.

Hereinafter, the first and second cleaning units 100 and 200 will be described in more detail with reference to FIGS. 2 and 3.

Figure 2:
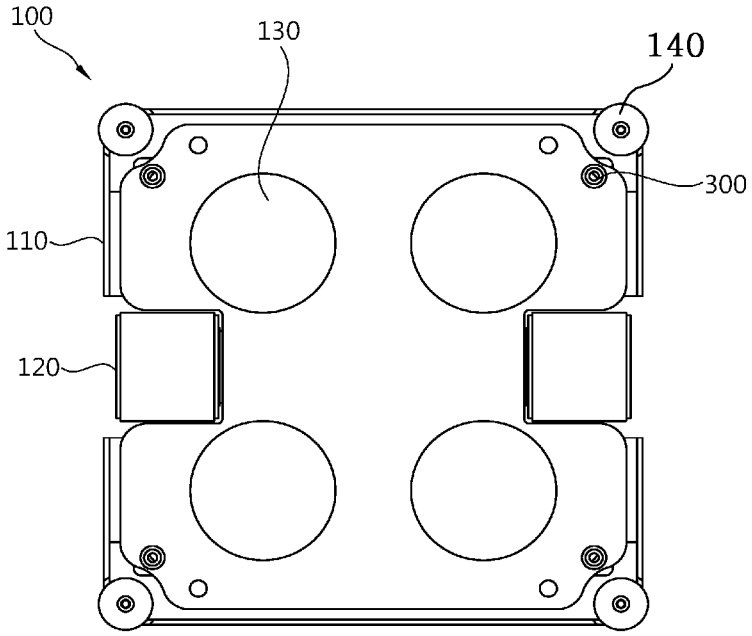
FIG. 2 is a plan view of a first cleaning unit disposed inside a window according to an embodiment.

FIG. 2 is a plan view of the first cleaning unit 100 according to an embodiment. FIG. 2 illustrates a top surface contacting a window of both surfaces of the first cleaning unit 100.

Referring to FIG. 2, the first cleaning unit 100 may include a first frame 110, a plurality of first wheel members 120, and a plurality of first magnetic modules 130.

The first frame 110 may constitute a body of the first cleaning unit 100, so that the first wheel members 120 and the first magnetic modules 130 may be coupled and fixed to the first frame 110.

A buffer member 140 may be disposed on an edge of the first frame 110 to minimize a shock when the window cleaning apparatus collides with a protrusion structure such as the frame of a window. When the shock is detected by a sensor (not shown) connected to the buffer member 140, the first cleaning unit 100 may change a moving path thereof.

In the current embodiment, although the first frame 110 of the first cleaning unit 100 has a rectangular shape in section, the present disclosure is not limited thereto. For example, the first frame 110 may have various structures having a circular or polygonal shape in section.

The first cleaning unit 100 may include the plurality of first magnetic modules 130. The first magnetic modules 130 may generate a magnetic force to attach the first and second cleaning units 100 and 200 to both surfaces of a window.

For example, the first magnetic modules 130 may include a permanent magnet such as a neodium magnet to generate a magnetic force together with second magnetic modules 233 of the second cleaning unit 200.

In more detail, the first magnetic modules 130 of the first cleaning unit 100 may include a magnet having a pole opposite to that of a magnet of the second magnetic modules 233 provided to the second cleaning unit 200. Thus, the first and second cleaning units 100 and 200 respectively disposed on both surfaces of a window may attract each other through the magnetic force. Accordingly, the first and second cleaning units 100 and 200 may be attached to the window to move together with each other.

According to another embodiment, the first and second magnetic modules 130 and 233 may include electromagnets except for the permanent magnets. According to further another embodiment, the first and second magnetic modules 130 and 233 may include permanent magnets and electromagnets.

The window cleaning apparatus is not limited to the first and second magnetic modules 130 and 233. Thus, the window cleaning apparatus may include various configurations in which the first and second cleaning units 100 and 200 may be attached to each other through the magnetic force and moved with a window therebetween.

For example, one of the first and second cleaning units 100 and 200 may include a magnetic body such as a permanent magnet or electromagnet, and the other may include a metal body that may be attracted by a magnetic force of the magnetic body.

Referring to FIG. 2, the first magnetic modules 130 may include four disk bodies that may be disposed on the top surface of the first cleaning unit 100 contacting a window.

The first magnetic modules 130 may be exposed in a direction in which the first magnetic modules 130 contact the window. Alternatively, the first magnetic modules 130 may be disposed adjacent to the top surface of the first cleaning unit using a separate cover member.

The first wheel members 120 may be provided at least in two on the left and right sides of the first cleaning unit 100 such that a portion of each of the first wheel members 120 is exposed to an upper side of the first frame 110. For example, as illustrated in FIG. 2, two wheel members may be disposed at the left and right sides of the first cleaning unit 100, respectively. Alternatively, four wheel members may be disposed at the four corners of the first cleaning unit 100, respectively.

For example, the first wheel members 120 may be rotated by a driving part (not shown) such as a motor disposed in the first frame 110. The first cleaning unit 100 attached to a window may be moved in a predetermined direction according to a rotation of each of the first wheel members 120.

The first cleaning unit 100 may be moved not only in a straight line direction, but also a curved line direction, that is, changed in a moving direction thereof. For example, a rotation shaft of the first wheel members 120 may be steered, or the first wheel members 120 at the left and right sides may be rotated at speeds different from each other to change the moving direction of the first cleaning unit 100.

Each of the first wheel members 120 may have a surface formed of a material such as fabric or rubber to generate a frictional force against a window when the first wheel members 120 are rotated. Thus, the first wheel members 120 may be easily moved along the inner surface of the window without idling. Furthermore, each of the first wheel members 120 may have a surface formed of a material to prevent a scratch from occurring on a window due to the rotation of the first wheel members 120.

When the first cleaning unit 100 is attached to a surface of a window by a magnetic force of the first magnetic modules 130, a reaction force perpendicular to the window may be applied to the first wheel members 120. In this state, when the driving part (not shown) such as a motor rotates the first wheel members 120, the first cleaning unit 100 may be moved on the inner surface of the window by the frictional force.

When the first cleaning unit 100 is moved by the rotation of the first wheel members 120, the second cleaning unit 200 attached to an opposite surface, i.e., an outer surface the window is integrally moved together with the first cleaning unit 100 by the magnetic force to perform a cleaning operation.

Figure 3:
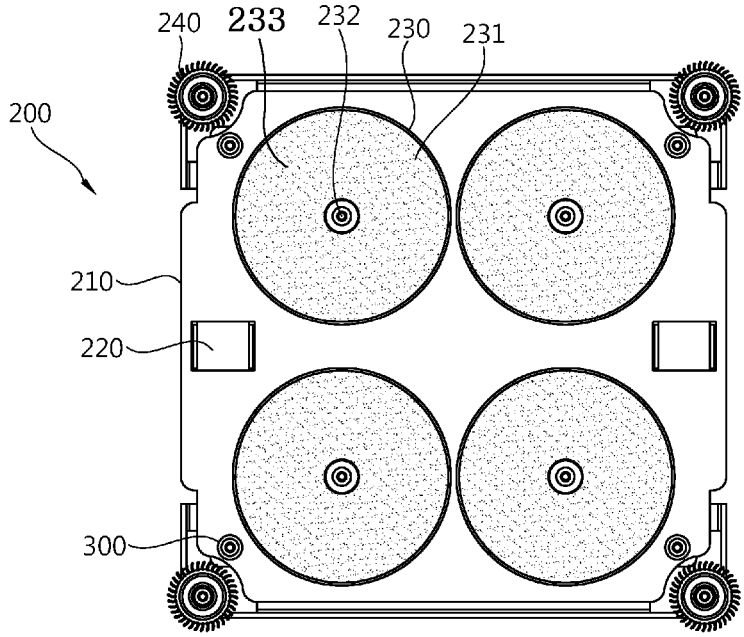
FIG. 3 is a plan view of a second cleaning unit disposed outside the window.

FIG. 3 is a plan view of the second cleaning unit 200 according to an embodiment. FIG. 2 illustrates a bottom surface contacting a window of both surfaces of the second cleaning unit 200.

Referring to FIG. 3, the second cleaning unit 200 may include a second frame 210, a plurality of second wheel members 220, and a plurality of cleaning modules 230.

The second frame 210 may constitute a body of the second cleaning unit 200. As described above, the second frame 210 may have a shape corresponding to that of the first frame 110. For example, the second frame 210 may have a plate structure having a rectangular shape in section.

The plurality of second wheel members 220 may be disposed on the bottom surface of the second frame 210 to move the second cleaning unit 200 by the magnetic force according to the movement of the first cleaning unit 100.

According to an embodiment, the second wheel members 220 may be connected to the second frame 210 through a shaft to smoothly rotate according to the movement of the second cleaning member 200 without being connected to the driving part such as the motor, unlike the first wheel member 120 of the first cleaning unit 100.

Accordingly, when the second cleaning unit 200 is moved together with the first cleaning unit 100 by the magnetic force, the second wheel member 220 may be rotated to perform a function similar to that of a bearing.

Although each of the second wheel members 220 has a cylindrical shape in FIG. 3, the present disclosure is not limited thereto. For example, a member having a globular shape such as a ball bearing may be used as the second wheel member 220.

The cleaning modules 230 may be exposed to the bottom surface of the second frame 210 to clean one surface of a window, e.g., the outer surface on which the second cleaning unit 200 is disposed.

As shown in FIG. 3, each of the cleaning modules 230 may include a plurality of modules, for example, a cleaning pad 231, a second magnetic module 233, and a detergent injection port 232. Also, the cleaning modules 230 may include four disk bodies corresponding to those of the first magnetic modules 130 of the first cleaning unit 100.

Each of the four disk bodies may be rotatably disposed by a driving part (not shown) such as a motor (not shown). Also, each of the cleaning modules 230 may protrude from a bottom surface of the second frame 210 at a predetermined interval. Thus, the second cleaning unit 200 may clean the outer surface of the window using a frictional force by the rotation of the cleaning modules 230 in a state where the second cleaning unit 200 is attached to the window.

A pad 231 formed of fabric or rubber to easily remove foreign materials from the window through a frictional force when rotated may be attached to the exposed surface of each of the cleaning modules 230. In this case, the pad 231 may be formed of a material having a microtriche structure or porous structure to improve cleaning performance of the window cleaning apparatus.

Also, the cleaning module 230 may include the detergent injection port 232. For example, the detergent injection port 232 may be connected to a detergent storage container (not shown) and a pump (not shown) which are disposed within the second cleaning unit 200 through a separate passage to receive a detergent. Thus, when a window is cleaned, the cleaning module 230 may inject the detergent onto the window through the detergent injection port 232 to perform the cleaning process.

The second magnetic module 233 may be disposed inside the cleaning module 230, i.e., under the pad 231 to overlap the pad 231. The second magnetic module 233 has a shape corresponding to that of the first magnetic module 233 of the first cleaning unit 100. Also, the second magnetic module 233 may generate a magnetic force to attach the first and second cleaning units 100 and 200 to both surfaces of the window.

The second magnetic module 233 may include a magnetic body or metal body such as a permanent magnet or electromagnet. Thus, the first and second cleaning units 100 and 200 respectively disposed on both surfaces of the window may be attracted with respect to each other by a magnetic force. As a result, the first and second cleaning units 100 and 200 may be attached to the window and moved together with each other.

For example, the cleaning module 230 may be disposed corresponding to the first magnetic module 130. Thus, the second magnetic module 233 including a neodium magnet having a pole opposite to that of the first magnetic module 130 may be disposed inside the cleaning module 230.

Accordingly, the first and second cleaning units 100 and 200 may be attached to both surfaces of the window by the magnetic force between the first magnetic module 130 and the second magnetic module 233 of the cleaning module 230, and also the first and second cleaning units 100 and 200 may be integrally moved.

Also, a force may be continuously applied to the cleaning module 230 in a window direction by the magnetic force between the first and second magnetic modules 130 and 233. Thus, when the cleaning module 230 is rotated, a fractional force against the window may be increased to improve the cleaning performance.

Referring to FIG. 3, a plurality of auxiliary cleaning modules 240 may be disposed on edges of the second cleaning unit 200. Since the cleaning module 230 is disposed inside the second frame 210, it may be difficult to clean edge portions of the window. Thus, the second cleaning unit may include the auxiliary cleaning modules 240 to more easily clean the edge portion of the window.

Each of the auxiliary cleaning module 240 may include a roller member (not shown) which is rotatably installed. Also, a brush may be disposed on an outer surface of the roller member. Thus, when the second cleaning unit 200 is moved along a window frame, the auxiliary cleaning modules 240 may be rotated by a fractional force against the window frame to remove foreign materials on the window frame.

As described above, the auxiliary cleaning modules 240 may perform the same function as the buffer member 140 of the first cleaning unit. That is, the auxiliary cleaning modules 240 may minimize a shock when the window cleaning apparatus collides with a protrusion structure such as the window frame and detect the shock using a sensor provided therein.

Referring to FIGS. 1 to 3, although the window cleaning apparatus cleans only one surface of the window, e.g., the outer surface of the window, this is merely an embodiment, and thus the present disclosure is not limited thereto.

For example, the first cleaning unit 100 may also include the cleaning module 230 of the second cleaning unit 200. Thus, the window cleaning apparatus may clean both surface of a window at the same time.

According to an embodiment, the window cleaning apparatus illustrated in FIGS. 1 to 3 may be adjusted to detect the magnetic force between the first and second cleaning units 100 and 200, which are attached and moved by the magnetic force with the window therebetween, thereby allowing the detected magnetic force to satisfy a preset reference value.

Figure 4:
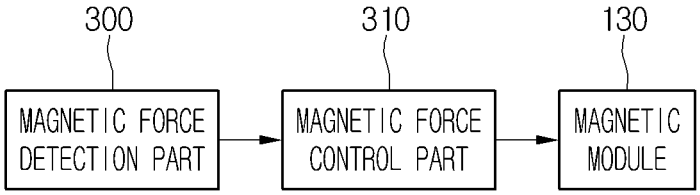
FIG. 4 is a block diagram of a magnetic force control device included in the window cleaning apparatus according to an embodiment.

FIG. 4 is a block diagram of a magnetic force control device included in the window cleaning apparatus according to an embodiment. The magnetic force control device may include a magnetic force detection part 300 and a magnetic force control part 310.

The window cleaning apparatus according to an embodiment may include components equal to those described with reference to FIGS. 1 to 3. In addition, as shown in FIG. 4, the window cleaning apparatus may further include the magnetic force control device to control a magnetic force.

Referring to FIG. 4, the magnetic force detection part 300 may detect a magnetic force between the first and second cleaning units 100 and 200 attached with a window therebetween. Thus, the magnetic force detection part 300 may include a magnetic sensor (not shown) which is disposed on at least one of the first and second cleaning units 100 and 200 to detect the magnetic force.

The magnetic force between the first and second cleaning units 100 and 200 may be a force for attaching the first and second cleaning units 100 and 200 to each other with a window therebetween. Also, the magnetic force may be a magnetic force between the first and second magnetic modules 130 and 233 respectively disposed within the first and second cleaning units 100 and 200.

The magnetic force control part 310 may control a magnetic force of the magnetic module 130 to allow the detected magnetic force to satisfy the preset reference value.

For example, the more the magnetic force between the first and second magnetic modules 130 and 233 is increased, the more the window cleaning apparatus may be stably attached to the window. However, when the frictional force between the first and second cleaning units 100 and 200 is increased, it may difficult to move the window cleaning apparatus.

On the other hand, the more the magnetic force between the first and second magnetic modules 130 and 233 is decreased, the more the frictional force may be decreased. Thus, the window cleaning apparatus may be easily moved. However, the window cleaning apparatus may drop down by an external shock.

Thus, as described above, the reference value of the magnetic force may be set in consideration of the attachment stability and mobility of the window cleaning apparatus. More particularly, a maximum magnetic force at which the window cleaning apparatus is easily moved may be set as a maximum value, and a minimum magnetic force at which the window cleaning apparatus is stably attached to a window may be set as a minimum value.

Thus, the magnetic force control part 310 may control the magnetic force between the first and second cleaning units 100 and 200 detected by the magnetic force detection part 300 within a range of the reference value. That is, when the magnetic force gets out between the maximum value and the minimum value, the magnetic force control part 310 may control the magnetic force between the first and second magnetic modules 130 and 233 within the range of the reference value.

Figure 5:
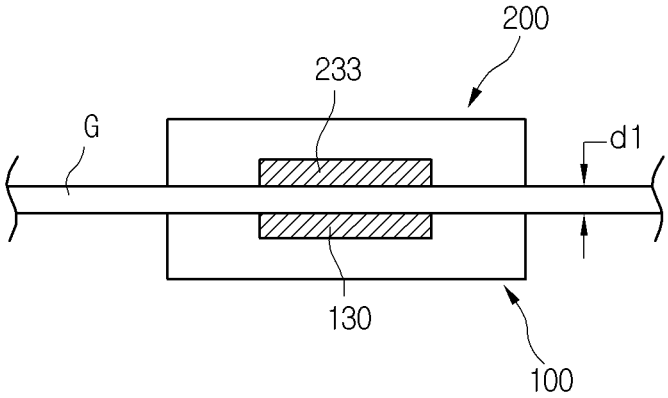
FIG. 5 is a sectional view for explaining a method of controlling a magnetic force according to a first embodiment.
Figure 5:
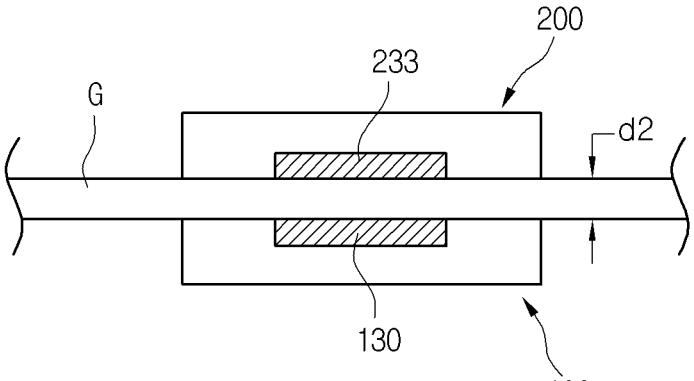

FIG. 5 is a sectional view for explaining a method of controlling a magnetic force according to a first embodiment. FIG. 5 schematically illustrates magnetic modules 130 and 233 of first and second cleaning units 100 and 200 respectively attached on both surfaces of a window G.

Referring to FIG. 5, windows G to be cleaned by the window cleaning apparatus according to the current embodiment may have thickness different from each other. For example, windows G having various thicknesses may be installed according to buildings, positions, or desired functions thereof.

When it is assumed that first and second magnetic modules 130 and 233 respectively provided in the first and second cleaning units 100 and 200 have the same magnetic force, a magnetic force between the first and second magnetic modules 130 and 233 may variable according to a thickness d of the window G.

That is, the more the thickness d of the window G is decreased, the more the magnetic force between the first and second magnetic modules 130 and 233 may be increased. Also, the more the thickness d of the window G is increased, the more the magnetic force between the first and second magnetic modules 130 and 233 may be decreased.

For example, since a window G illustrated in FIG. 5A has a thickness dl less than that d2 of a window G illustrated in FIG. 5B, a magnetic force between the first and second magnetic modules 130 and 233 illustrated in FIG. 5A may be greater than that between the first and second magnetic modules 130 and 233 illustrated in FIG. 5B.

As described above, when the magnetic force between the first and second magnetic modules 130 and 233 is increased, it may be difficult to move the window cleaning apparatus. Thus, in case of FIG. 5A, it may be necessary to decrease the magnetic force between the first and second magnetic modules 130 and 233.

Also, when the magnetic force between the first and second cleaning units 100 and 200 is decreased, it may be difficult to stably attach the window cleaning apparatus to the window.

Thus, in case of FIG. 5B, it may be necessary to increase the magnetic force between the first and second magnetic modules 130 and 233.

Thus, according to an embodiment, the magnetic force between the first and second cleaning units 100 and 200 may be changed according to the thickness d of the window G. Therefore, the magnetic force control part 310 may adjust the magnetic force between the first and second magnetic modules 130 and 233 to allow the magnetic force detected by the magnetic force detection part 300 to satisfy the reference value.

As described above, the magnetic force control part 310 may control the first magnetic module 130 of the first cleaning unit 100 to adjust the magnetic force between the first and second magnetic modules 130 and 233. However, the present disclosure is not limited thereto.

That is, the magnetic force control part 310 may control the second magnetic module 130 of the second cleaning unit 200 according to the magnetic force detected by the magnetic force detection part 300. Furthermore, the magnetic force control part 310 may simultaneously controls the first and second magnetic modules 130 and 233 to allow the magnetic force between the first and second magnetic modules 130 and 233 to satisfy the reference value.

As described above, the magnetic force between the first and second magnetic modules 130 and 233 may be adjusted to exist within a range of the preset reference value. Thus, the window cleaning apparatus may be stably attached to a window G having various thicknesses d and also easily moved to perform the cleaning.

As described above, the magnetic force between the first and second magnetic modules 130 and 233 may be changed according to the thickness d of the window G. However, the magnetic force between the first and second magnetic modules 130 and 233 may be changed according to other causes except for the thickness, for example, a power supply state, a surface state of the window G, a cleaning process, or a weather condition.

Hereinafter, a method of controlling a magnetic force in the window cleaning apparatus according to an embodiment will be described in detail with reference to FIGS. 6 to 16.

Figure 6:
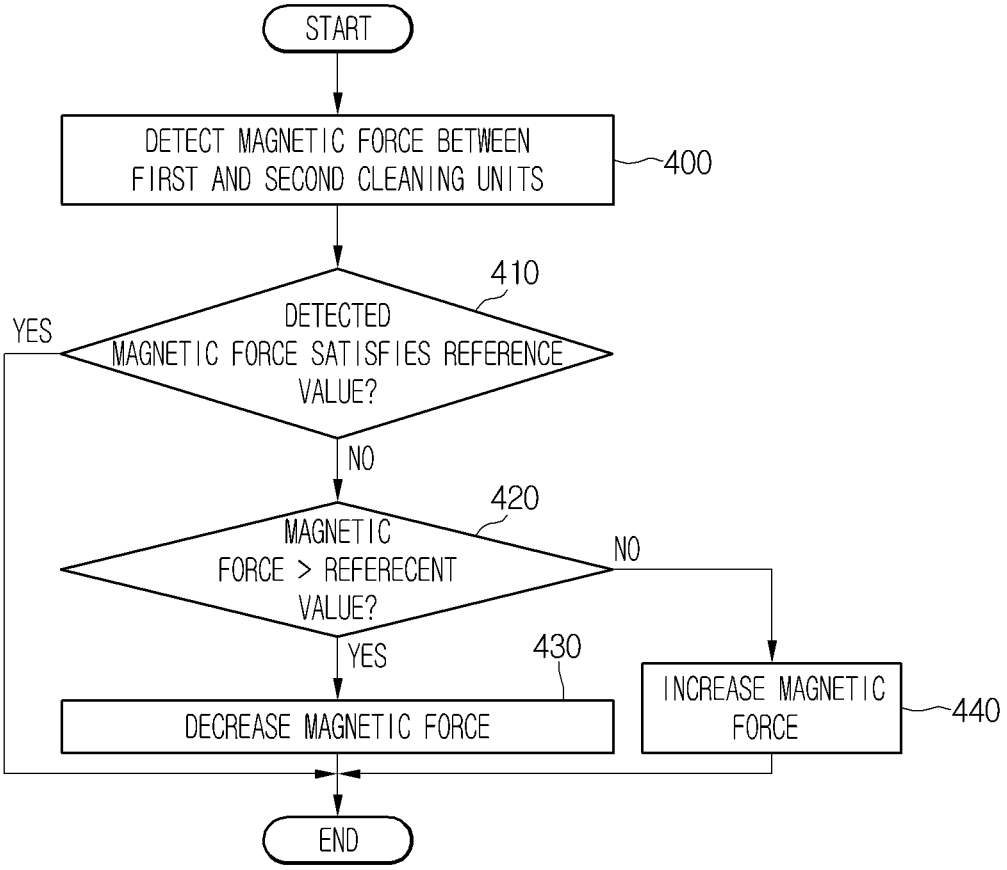
FIG. 6 is a flowchart illustrating a method of controlling a window cleaning apparatus according to the first embodiment.

FIG. 6 is a flowchart illustrating a method of controlling a window cleaning apparatus according to the first embodiment. The control method illustrated in FIG. 6 will be described by combing the block diagram illustrated in FIG. 4.

Referring to FIG. 6, in operation S400, a magnetic force detection part 300 of a window cleaning apparatus detects a magnetic force between first and second cleaning units 100 and 200. The magnetic force between the first and second cleaning units 100 and 200 may be detected by measuring a magnetic force between first and second magnetic units 130 and 233 of the first and second cleaning units 100 and 200 through a magnetic sensor (not shown) of a magnetic force detection part 300.

For this, the magnetic force detection part 300 may be disposed on at least one of the first and second cleaning units 100 and 200. That is, the magnetic force detection part 300 may be disposed adjacent to at least one of the first and second magnetic units 130 and 233.

In operation S410, the magnetic force control part 310 confirms whether the detected magnetic force satisfies a preset reference value. Then, when the detected magnetic force does not satisfy the preset reference value, the detected magnetic force is compared to the reference value in operation S420.

As a result, when the detected magnetic force is greater than the reference value, the magnetic force control part 310 decreases the magnetic force between the first and second magnetic modules 130 and 233 in operation S430.

When the detected magnetic force is less than the reference value, the magnetic force control part 310 increases the magnetic force between the first and second magnetic modules 130 and 233 in operation S440.

For example, when it is assumed that the reference value includes the above-described maximum value and minimum value, in a case where the detected magnetic force is greater than the maximum value of the reference value, the magnetic force control part 310 may decrease the magnetic force between the first and second magnetic modules 130 and 233 to adjust the magnetic force, thereby existing within a range of the reference value.

Also, in a case where the detected magnetic force is less than the minimum value of the reference value, the magnetic force control part 310 may decrease the magnetic force between the first and second magnetic modules 130 and 233 to adjust the magnetic force, thereby existing within the range of the reference value.

Figure 7:
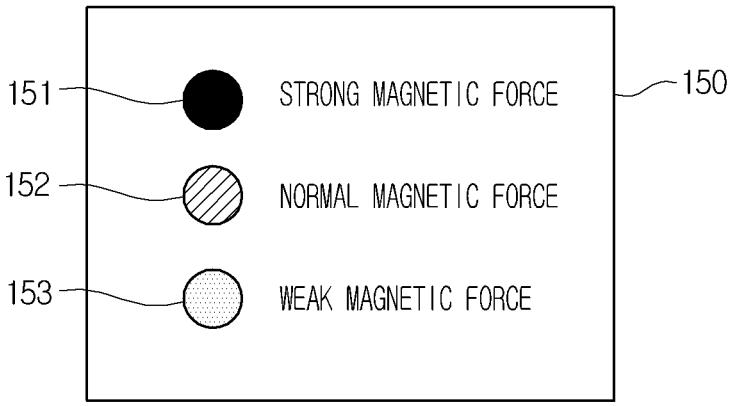
FIG. 7 is a view illustrating a method of displaying a detected magnetic force according to an embodiment.

Referring to FIG. 7, the detected magnetic force may be displayed by a display part 150 provided in the window cleaning apparatus to inform an intensity of the magnetic force.

The display part 150 may include a plurality of display units 151, 152, and 153 for displaying the detected magnetic force. The plurality of display units 151, 152, and 153 may include light sources for emitting light having colors different from each other, for example, light emitting diodes (LEDs).

For example, when the detected magnetic force is greater than the reference value, i.e., the maximum value of the reference value, the red LED unit 151 of the plurality of display units 151, 152, and 153 may emit light to express a 'strong magnetic force'. Also, when the detected magnetic force exists within the range of the reference value, the green LED unit 152 may emit light to express a 'normal magnetic force'. Also, when the detected magnetic force is less than the reference value, the yellow LED unit 153 may emits light to express 'weak magnetic force'.

The display part 150 may display the detected magnetic force through a method different from the above-described method. For example, the display part 150 may display the detected magnetic force into four or more stages or a digital value.

In this case, a user may confirm the magnetic force displayed on the display part 150, and then adjust the magnetic force between the first and second magnetic modules 130 and 233 using the magnetic force control part 300.

For example, when the red LED unit 151 expressing the 'strong magnetic force' on the display part 150 turns on, the user may decrease the magnetic force between the first and second magnetic modules 130 and 233 using the magnetic force control part 310 until the green LED unit 152 expressing the 'normal magnetic force' turns on.

On the other hand, when the yellow LED unit 153 expressing the 'weak magnetic force' turns on, the user may increase the magnetic force between the first and second magnetic modules 130 and 233 until the green LED unit 152 expressing the normal magnetic force' turns on.

According to an embodiment, the magnetic force control method described with reference to FIG. 6 may be performed at a time point at which window cleaning starts using the window cleaning apparatus, i.e., the first and second cleaning units 100 and 200 are attached on both surfaces of the window.

For example, the magnetic force between the first and second magnetic modules 130 and 233 may have a very weak value, i.e., a value less than the reference value before the window cleaning starts. Accordingly, the user may attach the first and second cleaning units 100 and 200 on both surfaces of the window and increase the magnetic force between the first and second magnetic modules 130 and 233 using the magnetic force control part 310.

That is, the user may attach the first and second cleaning units 100 and 200 on the window and then increase the magnetic force between the first and second magnetic modules 130 and 233 until the green LED unit 152 turns on the display part 150. After the green LED unit 152 turns on, the user may commands the window cleaning apparatus to start the window cleaning.

Unlike the manual control of the magnetic force by the user, the magnetic force between the first and second magnetic modules 130 and 233 may be automatically controlled by the magnetic force control part 310 when the window cleaning apparatus is attached on the window.

That is, when the user attaches the first and second cleaning units 100 and 200 on a window, the yellow LED unit 153 turns on first. Then, the magnetic force between the first and second magnetic modules 130 and 233 may be automatically controlled by the magnetic force control part 310 until the green LED unit 152 turns on. Also, the user may command the window cleaning apparatus to start the window cleaning after the green LED unit 152 turns on the display part 150.

Figure 8:
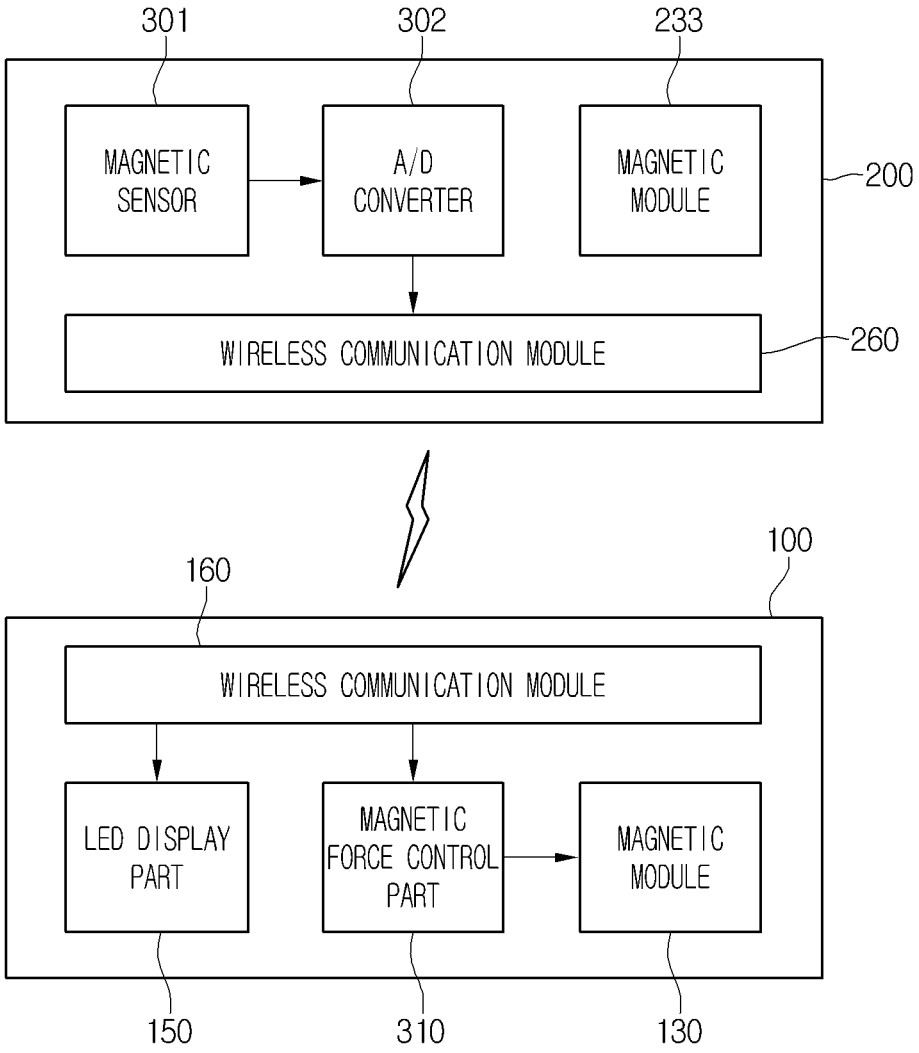
FIG. 8 is a block diagram of first and second cleaning units included in a window cleaning apparatus according to an embodiment.

FIG. 8 is a block diagram of first and second cleaning units included in a window cleaning apparatus according to an embodiment. Hereinafter, descriptions of the same parts as those of FIGS. 1 to 7 in first and second units 100 and 200 illustrated in FIG. 8 will be omitted.

Referring to FIG. 8, the first cleaning unit 100 may include a first magnetic module 130, an LED display part 150, a first wireless communication module 160, and a magnetic force control part 310. Also, the second cleaning unit 200 may include a second magnetic module 233, a second wireless communication module 260, a magnetic sensor 301, and an A/D converter 302.

The magnetic sensor 301 of the second cleaning unit 200 may measure a magnetic force between the first and second magnetic modules 130 and 233. Then, the measured magnetic force may be converted into a digital value by the A/D converter 302. For this, the magnetic sensor 301 may be disposed at a position adjacent to the second magnetic module 233.

The first wireless communication module 160 of the first cleaning unit 100 and the second wireless communication module 260 of the second cleaning unit 200 may transmit/receive a signal to/from each other using local area wireless communication such as Bluetooth or Zigbee.

The second wireless communication module 260 transmits the magnetic force converted into the digital value into the first wireless communication module of the first cleaning unit 100. Thus, the first cleaning unit 100 may receive a magnetic value detected by the second cleaning unit 200.

The magnetic force value received from the first wireless communication module 160 may be inputted into the magnetic force control part 310. Then, the magnetic force control part 310 controls the first magnetic module 130 according to the inputted magnetic force value to adjust a magnetic force between the first and second magnetic modules 130 and 233.

In this case, the magnetic force control part 310 may adjust the magnetic force between the first and second magnetic modules 130 and 233 using the method described with reference to FIGS. 4 to 7. Thus, their detailed descriptions will be omitted.

For example, the magnetic force control part 310 may vary a position of the first magnetic module 130 to adjust the magnetic force between the first and second magnetic modules 130 and 233. Thus, the magnetic force may be adjusted by the adjusting a distance between the first and second magnetic modules 130 and 233.

Particularly, when the first magnetic module 130 may be changed in position by the magnetic force control part 310 to increase the distance between the first and second magnetic modules 130 and 233, the magnetic force between the first and second magnetic modules 130 and 233 may be decreased. Thus, when the distance between the first and second magnetic modules 130 and 233 is decreased, the magnetic force between the first and second magnetic modules 130 and 233 may be increased.

According to another embodiment, when the first magnetic module 130 includes an electromagnet, the magnetic force control part 310 may vary an amount of current supplied into the first magnetic module 130 to adjust the magnetic force between the first and second magnetic modules 130 and 233.

Hereinafter, a structure and method in which a distance between the first and second magnetic modules 130 and 233 is adjusted to control a magnetic force between the first and second magnetic modules 130 and 233 will be described in detail with reference to FIGS. 9 to 12.

Figure 9:
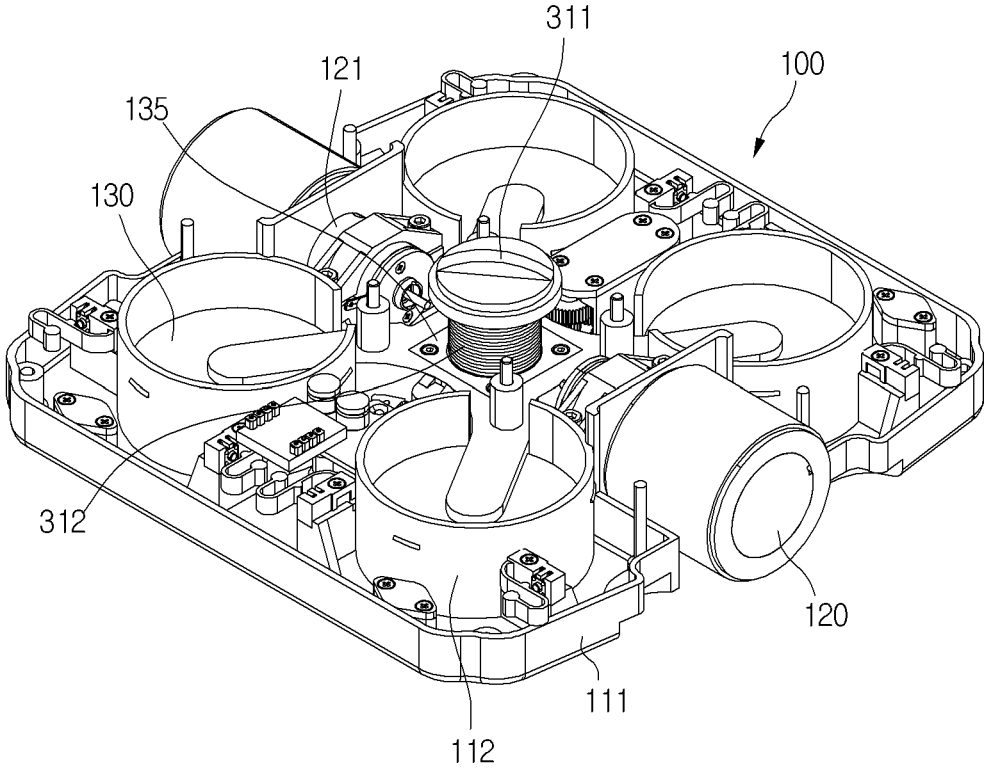
FIG. 9 is a perspective view of a first cleaning unit according to the first embodiment.

FIG. 9 is a perspective view of a first cleaning unit according to the first embodiment. FIG. 9 illustrates an inner structure of a first cleaning unit 100. Hereinafter, descriptions of the same parts as those of FIGS. 1 to 8 in the first cleaning unit 100 illustrated in FIG. 9 will be omitted.

Referring to FIG. 9, a magnetic force control part 300 of the first cleaning unit 100 may include a rotation member 311 and a rotation shaft 312 coupled to the rotation member 311 and having a screw thread ascending in one direction on an outer surface thereof.

A through hole 135 in which the rotation shaft 312 of the magnetic force control part 300 passes and is coupled may be defined in the first magnetic module 130. A screw thread having a shape corresponding to the screw thread of the rotation shaft 312 may be disposed on an inner surface of the through hole 135 of the first magnetic module 130.

Figure 10:
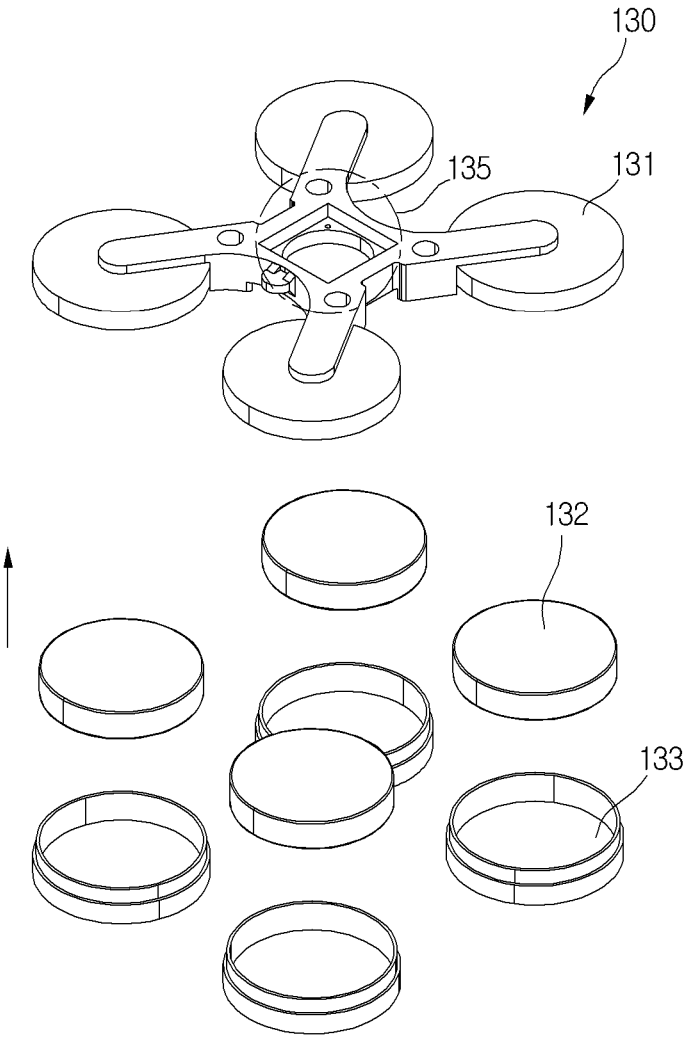
FIG. 10 is a perspective view of a magnetic module illustrated in FIG. 9.

Referring to FIG. 10, the first magnetic module 130 may include an upper case 131 in which the through hole 135 is defined in a center thereof, a magnetic body 132, and a lower case 133. The magnetic body 132 including a permanent magnet such as a neodium magnet may be disposed in an inner space between the upper case 131 and the lower case 133.

Also, a first frame 110 of the first cleaning unit 100 may include a first lower frame 111. The first magnetic module 130 may be disposed within a guide member 112 connected to the first lower frame 111.

When the rotation shaft 312 is rotated in one direction, the screw thread of the rotation shaft 312 and the screw thread of the through hole 135 may be coupled to each other. Thus, the first magnetic module 130 may be guided by the guide member 112 to ascend or descend.

When the first magnetic module 130 ascends, a distance between the first and second magnetic modules 130 and 233 may be decreased to increase a magnetic force between the first and second magnetic modules 130 and 233. Also, when the first magnetic module 130 descends, the distance between the first and second magnetic modules 130 and 233 may be increased to decrease the magnetic force between the first and second magnetic modules 130 and 233.

According to an embodiment, a user may rotate the rotation member 311 in a first direction (e.g., a counterclockwise direction) to allow the first magnetic module 130 to ascend.

Thus, the distance between the first and second magnetic modules 130 and 233 may be decreased to increase a magnetic force.

On the other hand, the user may rotate the rotation member 311 in a second direction (e.g., a clockwise direction) to allow the first magnetic module 130 to descend. Thus, the distance between the first and second magnetic modules 130 and 233 may be increased to decrease a magnetic force.

For example, when a yellow LED unit 153 turns on an LED display part 150, the user may rotate the rotation member 311 in the counterclockwise direction to increase the magnetic force until a green LED unit 152 turns on to allow the magnetic force between the first and second magnetic modules 130 and 233 to exist within a reference value.

When a red LED unit 151 turns on the LED display part 150, the user may rotate the rotation member 311 in the clockwise direction to decrease the magnetic force until the green LED unit 152 turns on.

According to another embodiment, the magnetic force control part 310 may include a driving part such as a motor to rotate the rotation shaft 312. Thus, the first magnetic module 130 may automatically ascend or descend by the magnetic force control part 310.

Figure 11:
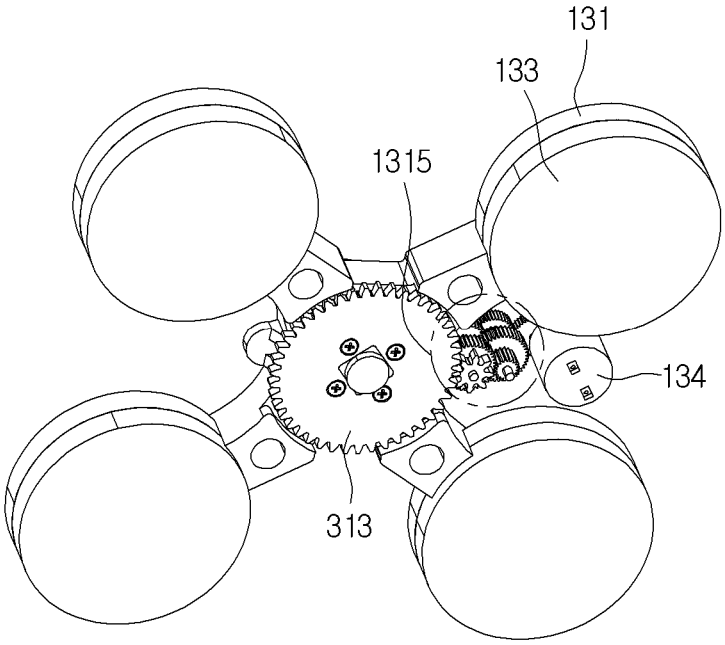
FIG. 11 is a perspective view of a magnetic force control part illustrated in FIG. 9.

FIG. 11 is a perspective view of a magnetic force control part illustrated in FIG. 9. FIG. 11 illustrate a coupling structure between the first magnetic module 130 and the magnetic force control part 310 when viewed from a lower side.

Referring to FIG. 11, the magnetic force control part 310 may include a rotation shaft gear 131, a motor 134, and a power transmission part 135.

The rotation shaft gear 131 may be connected to a lower end of the rotation shaft 312. Thus, as the rotation shaft gear 131 is rotated, the rotation shaft 312 may be rotated in one direction.

The magnetic force control part 310 may operate the motor 134 to rotate the rotation shaft gear 131 coupled to the rotation shaft 312. The power transmission part 135 may include a plurality of gears to transit a power into the rotation shaft gear 131.

For example, when the magnetic force between the first and second magnetic modules 130 and 233 is less than the reference value, the magnetic force control part 310 may operate the motor 134 so that the rotation shaft gear 131 is rotated in the first direction (e.g., the counterclockwise direction). Thus, the first magnetic module 130 may automatically ascend to increase the magnetic force between the first and second magnetic modules 130 and 233 up to the reference value.

On the other hand, when the magnetic force between the first and second magnetic modules 130 and 233 is greater than the reference value, the magnetic force control part 310 may operate the motor 134 so that the rotation shaft gear 131 is rotated in the second direction (e.g., the clockwise direction). Thus, the first magnetic module 130 may automatically descend to decrease the magnetic force between the first and second magnetic modules 130 and 233 up to the reference value.

Figure 12:
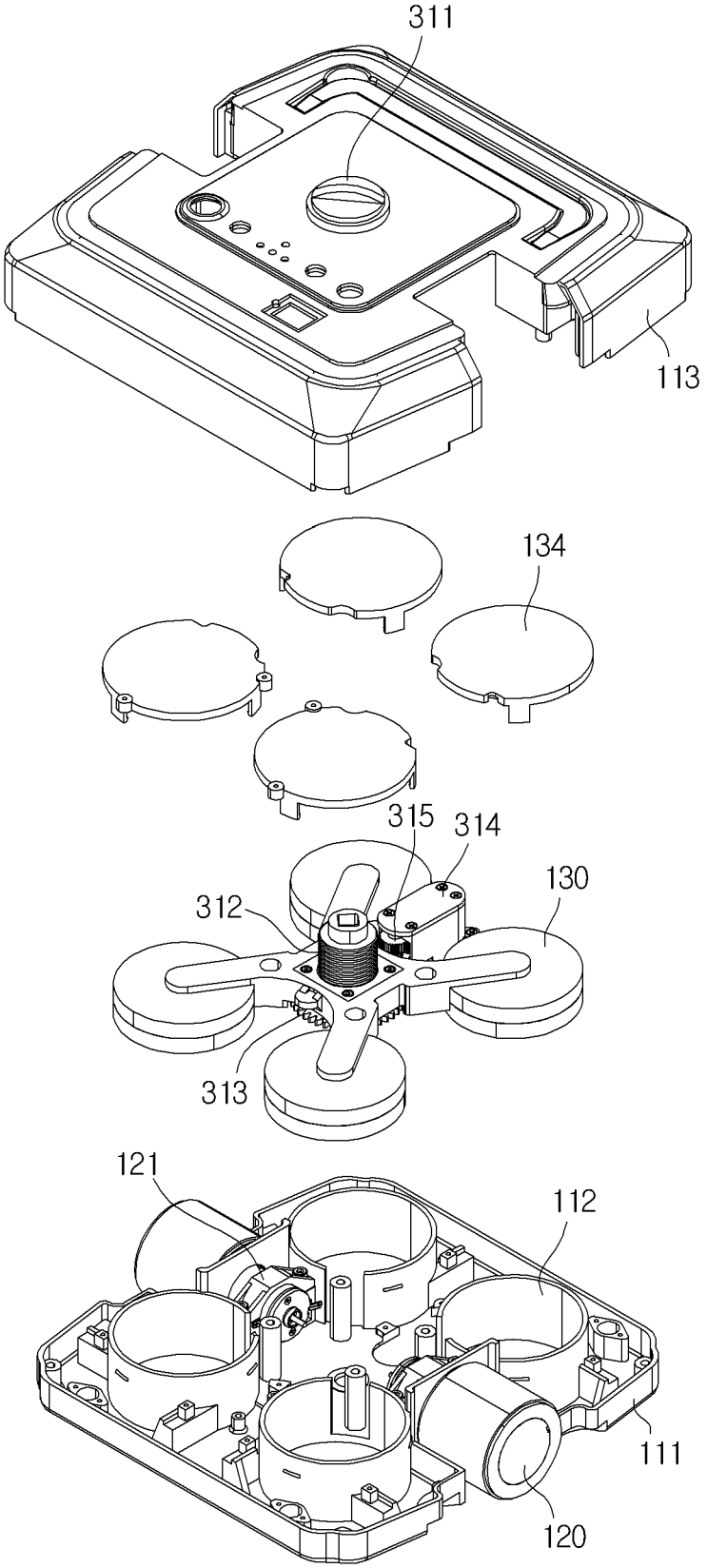
FIG. 12 is a partial perspective view of a first cleaning unit according to a second embodiment.

FIG. 12 is a partial perspective view of a first cleaning unit according to a second embodiment. Hereinafter, descriptions of the same parts as those of FIGS. 1 to 11 in the first cleaning unit 100 illustrated in FIG. 12 will be omitted.

Referring to FIG. 12, a first frame 110 of the first cleaning unit 100 may include a first upper frame 113 and a first lower frame 111. A first magnetic module 130 and a magnetic force control part 310 may be disposed within the first upper frame 113 and the first lower frame 111.

Also, an attachment/detachment member 150 for allowing a user to easily attach or detach the first cleaning unit 100 to or from a window, e.g., a handle may be connected to the first upper frame 113. Also, first wheel members 120 and wheel fixing parts 121 including motors for rotating the first wheel members 120 may be fixed to the first lower frame.

A module cover 134 may be disposed above the first magnetic module 130. As shown in FIG. 12, four module covers 134 may be coupled to an upper end of a guide part 112 of the first lower frame 111.

According to an embodiment, the magnetic force control method described with reference to FIG. 6 may be performed during the window cleaning process.

For example, when a window cleaning apparatus according to an embodiment is moved to clean a window, the magnetic force control method described with reference to FIG. 6 may be performed at a certain period to allow a magnetic force control part 310 to adjust a magnetic force between first and second magnetic modules 130 and 233 according to a magnetic force detected by a magnetic power detection part 300.

Figure 13:
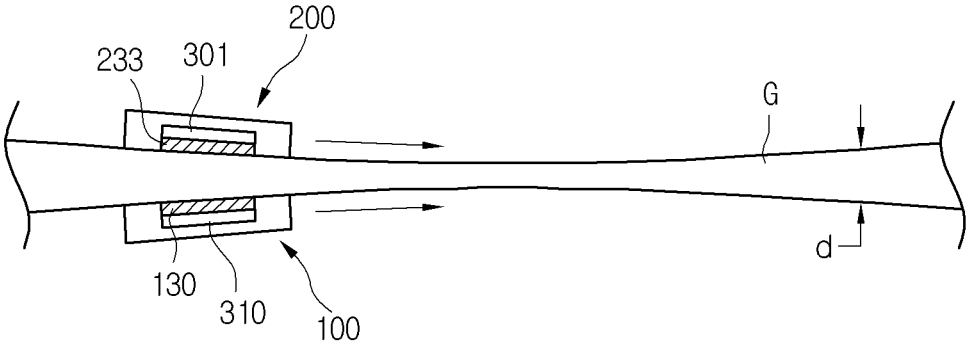
FIG. 13 is a sectional view for explaining a method of controlling a magnetic force according to the second embodiment.

FIG. 13 is a sectional view for explaining a method of controlling a magnetic force according to the second embodiment. Hereinafter, descriptions of the same parts as those of FIGS. 1 to 12 in first and second units 100 and 200 illustrated in FIG. 13 will be omitted.

Referring to FIG. 13, when the first and second cleaning units 100 and 200 are moved, a magnetic sensor 301 may measure the magnetic force between the magnetic modules 130 and 233 at a certain period, e.g., about 10 seconds. Then, the magnetic force control part 310 may compare the measured magnetic force to a reference value to allow the magnetic force between the first and second magnetic modules 130 and 233 to satisfy the reference value.

As shown in FIG. 13, a window G may have a thin thickness d in a central area when compared to that of an outer area. In this case, the first and second cleaning units 100 and 200 may be moved in an arrow direction to gradually increase the magnetic force measured by the magnetic sensor 301.

Thus, the magnetic force control part 310 may move the first and second cleaning units 100 and 200 in the arrow direction using the magnetic force measured by the magnetic sensor 301 at a certain period to gradually decrease the magnetic force between the first and second magnetic modules 130 and 233.

Figure 14:
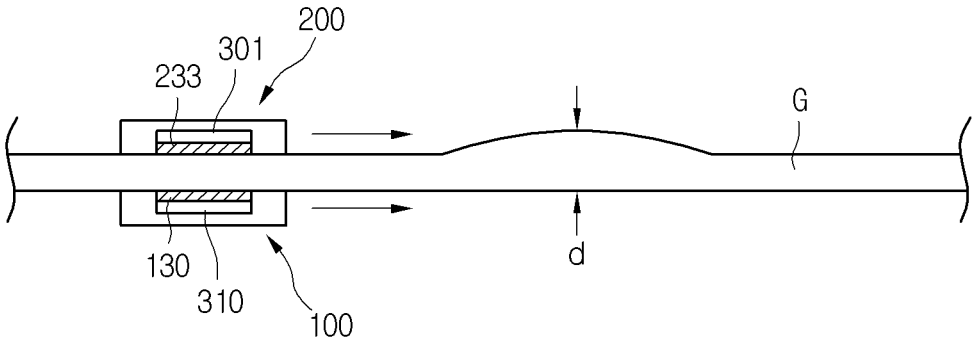
FIG. 14 is a sectional view for explaining a method of controlling a magnetic force according to a third embodiment.

Referring to FIG. 14, a portion of the window G may protrude. In this case, the first and second cleaning units 100 and 200 may be moved in the arrow direction to gradually decrease the magnetic force measured by the magnetic sensor 301.

Thus, the magnetic force control part 310 may move the first and second cleaning units 100 and 200 in the arrow direction using the magnetic force measured at a certain period to gradually increase the magnetic force between the first and second magnetic modules 130 and 233.

As described above, when the magnetic force control part 310 controls the magnetic force between the first and second magnetic modules 130 and 233 using the magnetic force measured at a certain period, it may prevent the magnetic force between the first and second magnetic modules 130 and 233 from getting out of the reference value during the window cleaning process of the window cleaning apparatus. Thus, the attachment stability and mobility of the window cleaning apparatus may be improved.

Figure 15:
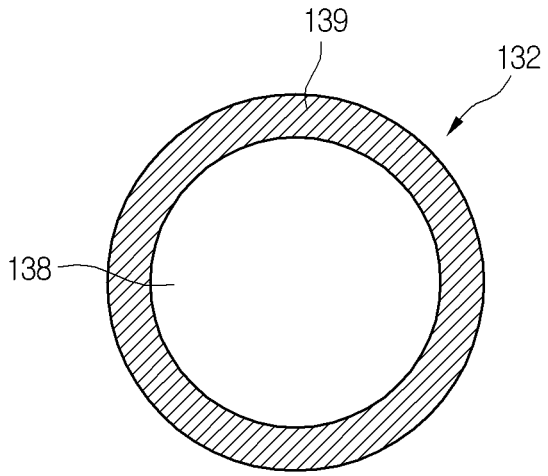
FIG. 15 is a plan view of a magnetic body included in the magnetic module according to an embodiment.

FIG. 15 is a plan view of a magnetic body included in the magnetic module. FIG. 15 illustrates at least one of the first and second magnetic modules 130 and 233 of the first and second cleaning units 100 and 200 according to an embodiment.

Referring to FIG. 15, a magnetic body 132 of the magnetic module 130 may include a permanent magnet 138 and an electromagnet 139.

In this case, the permanent magnet 138 may continuously provide a minimum magnetic force of the magnetic body 132 and the electromagnet 139 may variably provide an additional magnetic force according to an amount of applied current.

For example, the magnetic force control part 310 may control an amount of current applied into the electromagnet 139 according to a magnetic force measured by a magnetic force detection part 300. Thus, the additional magnetic force provided by the electromagnet 139 may be variable. As the magnetic force of the electromagnet 139 of the magnetic body 132 is varied, the magnetic force between the first and second magnetic modules 130 and 233 may be adjusted.

As described above, since the magnetic body 132 includes the permanent magnet 138 and the electromagnet 139, the magnetic force between the first and second magnetic modules 130 and 233 may be easily adjusted, and also power consumption for generating the magnetic power may be reduced.

According to another embodiment, the above-described magnetic power control method may be applied also when the window cleaning apparatus is separated.

Figure 16:
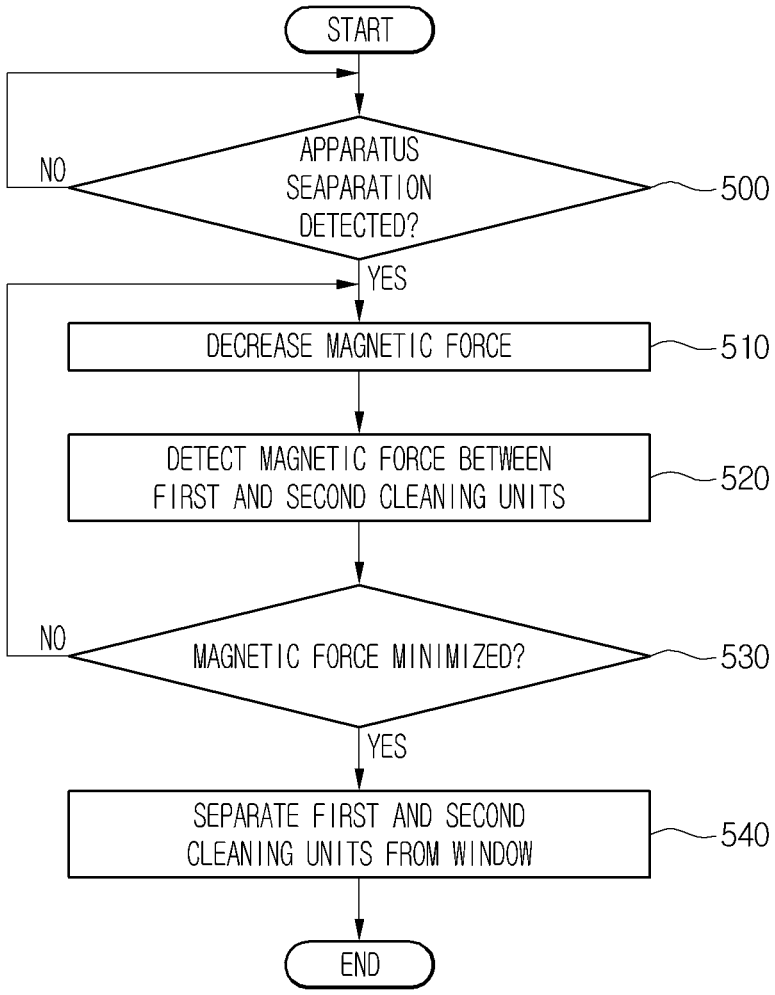
FIG. 16 is a flowchart illustrating a method of controlling a window cleaning apparatus according to a second embodiment.

FIG. 16 is a flowchart illustrating a method of controlling a window cleaning apparatus according to the second embodiment.

Referring to FIG. 16, it is detected whether a window cleaning apparatus is separated from a window in operation S500.

For example, a user may separate first and second cleaning units 100 and 200 from the window after window cleaning is finished. For this, the user may apply a predetermined force to handles 150 and 250 disposed on the first and second cleaning units 100 and 200.

Thus, a sensor (not shown) may be disposed on each of the handles 150 and 250 of the first and second cleaning units 100 and 200. When a force having a level greater than a predetermined level is applied to the handles 150 and 250, it may be detected that the user separates the window cleaning apparatus from the window.

To prevent one of the first and second cleaning units 100 and 200 from being separated from the window to drop down, the window cleaning apparatus may recognize a separation time point only when the force having a level greater than a predetermined level is applied to the two handles 150 and 250 of the first cleaning units 100 and 200.

When the separation of the window cleaning apparatus is detected, a magnetic power control part 310 may decrease a magnetic force between first and second magnetic modules 130 and 250 in operation S510. Also, in operation S520, a magnetic power detection part 300 may detect the magnetic force between the first and second magnetic modules 130 and 233.

Thereafter, in operation S530, the magnetic force control part 310 may confirm whether the detected magnetic force is minimized. Then, the magnetic force control part 310 repeatedly performs the operations S510 and S520 until the magnetic force is minimized.

Whether the magnetic force is minimized may be confirmed by determining whether the detected magnetic force is decreased up to a preset minimum magnetic force. The minimum magnetic force may be preset as a value enough to easily separate the first and second cleaning units 100 and 200 from the window using handles 150 and 250 by a user.

Hereinafter, since a method for decreasing the magnetic force between the first and second magnetic modules 130 and 233 through the magnetic force control part 310 is equal to that described with reference to FIGS. 4 to 15, their detailed descriptions will be omitted.

When the magnetic force between the first and second magnetic modules 130 and 233 is minimized, the first and second cleaning units 100 and 200 are separated from a window in operation S540.

For example, the user confirms that the magnetic force between the first and second magnetic modules 130 and 233 is minimized, and than may easily separate the first and second cleaning units 100 and 200 from the window using the two handles 150 and 250.

In more detail, an LED display part 150 may include a separate display unit for expressing that the magnetic force between the first and second magnetic modules 130 and 233 is minimized, e.g., a separate LED unit. Thus, when the LED unit turns on, the user may apply a force to the two handles 150 and 250 grasped thereby to separate the first and second cleaning units 100 and 200 from the window.

According to an embodiment, the window cleaning apparatus for cleaning a window while being attached and moved on the window may decide a moving path on the basis of a width of a window that is a target to be cleaned. Thus, the window cleaning apparatus may perform the cleaning while being moved along the decided moving path.

Figure 17:
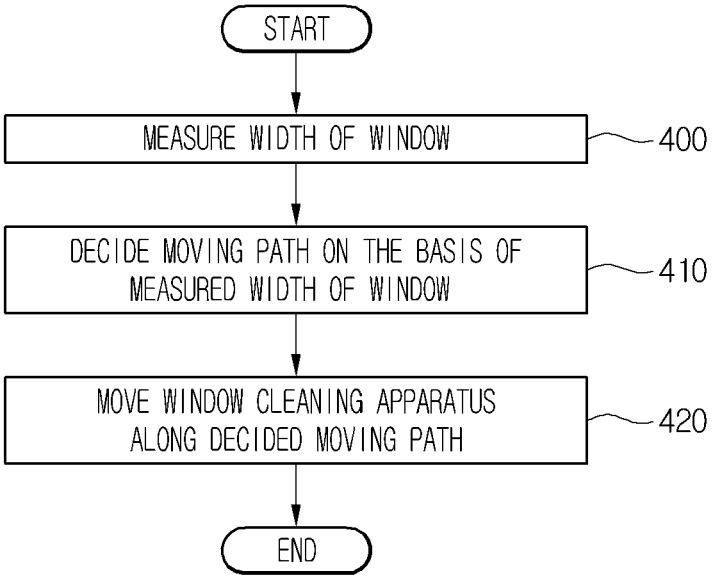
FIG. 17 is a flowchart illustrating a method of controlling a window cleaning apparatus according to an embodiment.

FIG. 17 is a flowchart illustrating a method of controlling a window cleaning apparatus according to an embodiment. The moving control method may be performed by a window cleaning apparatus, i.e., a control module (not shown) provided in the window cleaning apparatus.

Referring to FIG. 17, the control module measures a width of a window in operation S600. Then, in operation S610, the control module decides a moving path of the window cleaning apparatus on the basis of the measured width of the window.

For example, the control module may measure a width of a window to be cleaned by moving the window cleaning apparatus in a left or right direction from a position attached by a user. The moving path of the window cleaning apparatus may be differently decided according to the measured width of the window.

When the moving path of the window cleaning apparatus is decided, the control module moves the window cleaning apparatus along the decided moving path in operation S620.

That is, the window cleaning apparatus according to the current embodiment may perform the cleaning while being moved along the moving path decided on the basis of the width of the window.

Figure 18:
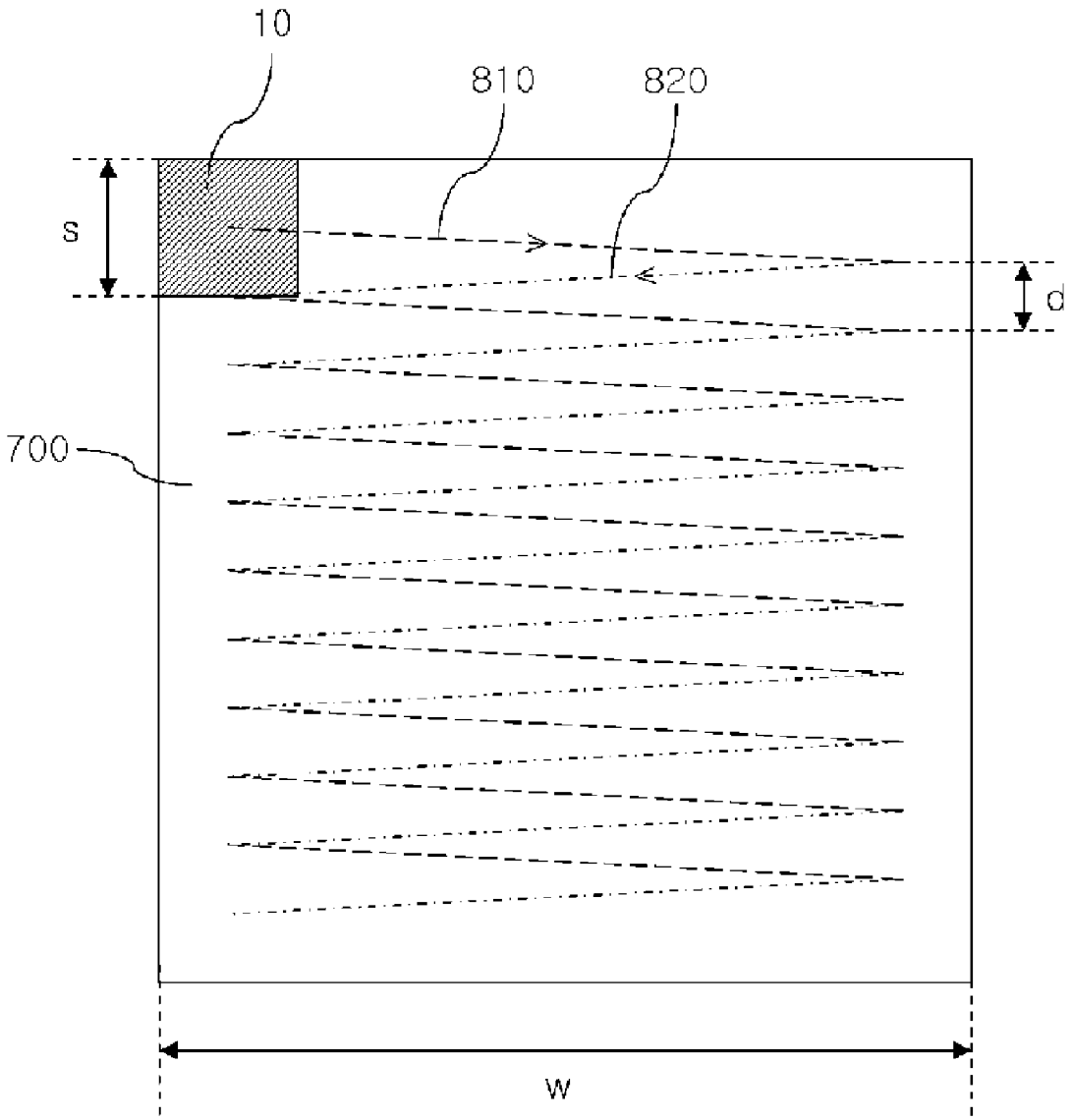
FIG. 18 is a view illustrating a moving path of the window cleaning apparatus according to an embodiment.

FIG. 18 is a view illustrating a moving path of the window cleaning apparatus.

Referring to FIG. 18, a window cleaning apparatus 10 may be repeatedly moved within a first section in which the window cleaning apparatus 10 is moved from an end of one side of a window 700 to an end of the other side to perform cleaning and a second section in which the window cleaning apparatus 10 is moved from the end of the other side to the end of the one side to perform the cleaning.

For example, a moving path of the window cleaning apparatus 10 may include a right downward section 810 in which the window cleaning apparatus 10 is moved downward in a right direction from a left end to a right end and a left downward section 820 in which the window cleaning apparatus 10 is moved downward in a left direction from a right end to a right end. As shown in FIG. 18, the right downward section 810 and the left downward section 820 may be alternately repeated.

An angle at which the window cleaning apparatus 10 is moved downward in the right downward section 810 and the left downward section 820 may be set a vertical distance d of the moving path, i.e., a distance between positions of two ends adjacent to each other of the moving path of the window cleaning apparatus.

For example, in a case where the vertical distance d of the moving path is required to be increased, the downward moving angle of the window cleaning apparatus 10 may be set to be increased. Thus, the window cleaning may be more minutely performed. However, a time required for cleaning the window may be increased.

On the other hand, in a case where the vertical distance d of the moving path is required to be decreased, the downward moving angle of the window cleaning apparatus 10 may be set to be decreased. Thus, a time required for cleaning the window may be decreased. However, it may be difficult to minutely perform the window cleaning.

Also, the vertical distance d of the moving path may be preset to a predetermined value, e.g., a value of about ½ of a size s of the window cleaning apparatus 10. The vertical distance d of the moving path may be decreased or increased according to the desired time required for cleaning the window or the minute degree of the cleaning.

The window cleaning apparatus 10 may be slid downward by gravity during the movement in the right or left direction. The window cleaning apparatus 10 may be moved at a downward angle greater than the preset value by the dropping.

Also, a dropping degree of the window cleaning apparatus 10 due to the gravity may be changed according to a width w of the window 700.

That is, the more the width w of the window 700 is increased, the more the dripping degree of the window cleaning apparatus 10 may be increased. A variation of the dropping degree of the window cleaning apparatus 10 may change the vertical distance d of the moving path.

For example, the more the width w of the window 700 is increased, the more the dripping degree of the window cleaning apparatus 10 may be increased by the gravity. Thus, the vertical distance d of the moving path may be increased.

When the vertical distance d of the moving path is changed, for example, when the vertical distance d of the moving path is increased, it may be difficult to minutely clean the window 700 to satisfy the user.

According to an embodiment, the moving path of the window cleaning apparatus 10 is decided according to the width w of the window 700 to compensate the dropping of the window cleaning apparatus 10 due to the gravity. Thus, the set value of the vertical distance d of the moving path, e.g., the value of about ½ of the size s of the window cleaning apparatus 10, or the value set by the user may be maintained.

As described above, the method of controlling the movement of the window cleaning apparatus 10 may be applied to the window cleaning apparatus described with reference to FIGS. 1 to 3.

In this case, a first cleaning unit 100 attached to an inner surface of the window 700 in first and second cleaning units 100 and 200 included in the window cleaning apparatus may be moved along the moving path decided as described above. Also, a second cleaning unit 200 attached to an outer surface of the window 700 may be moved by a self-weight thereof due to the movement of the first cleaning unit 100.

Hereinafter, a method of controlling a movement of a window cleaning apparatus 10 will be described in detail with reference to FIGS. 19 to 26.

A case in which a first cleaning unit 100 attached to an inner surface in first and second cleaning units 100 and 200 included in a window cleaning apparatus 10 is moved by the movement control method according to an embodiment will be described as an example.

Figure 19:
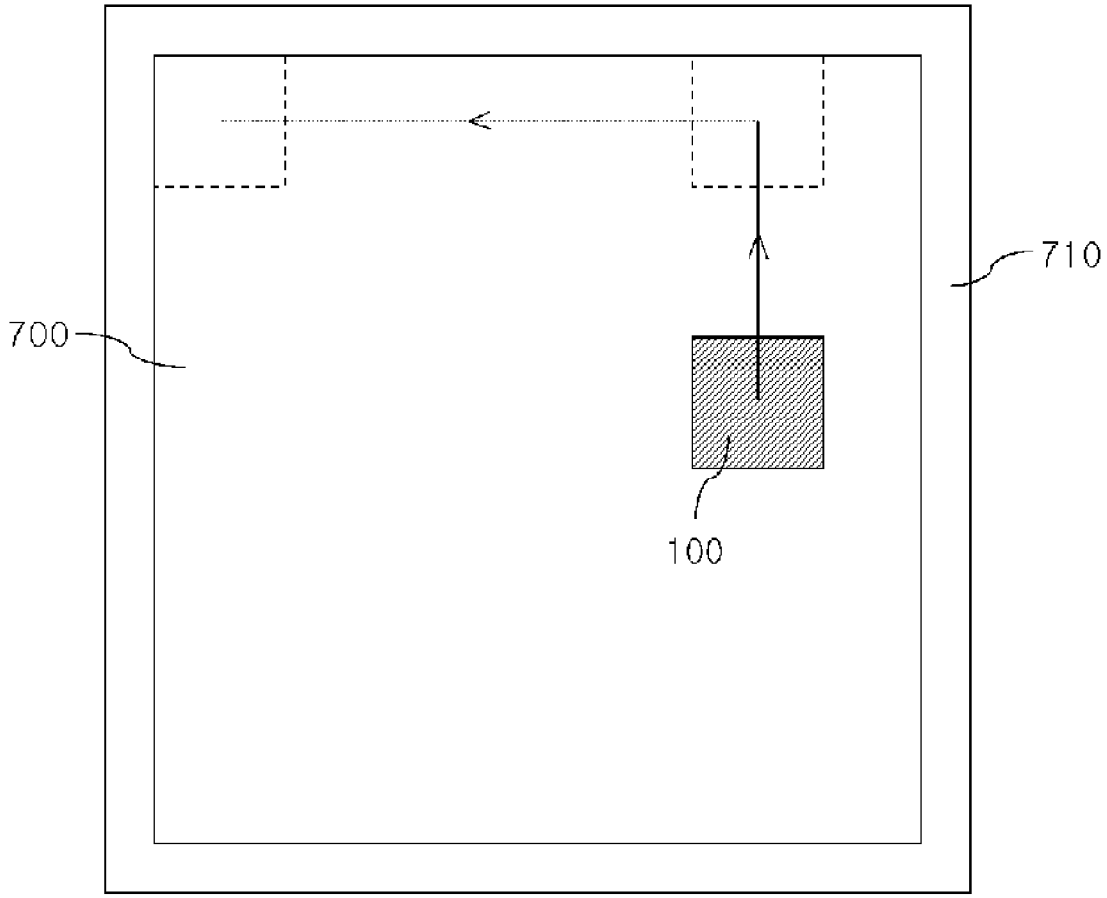
FIGS. 19 and 20 are views illustrating a method of measuring a width of a window according to an embodiment.
Figure 20:
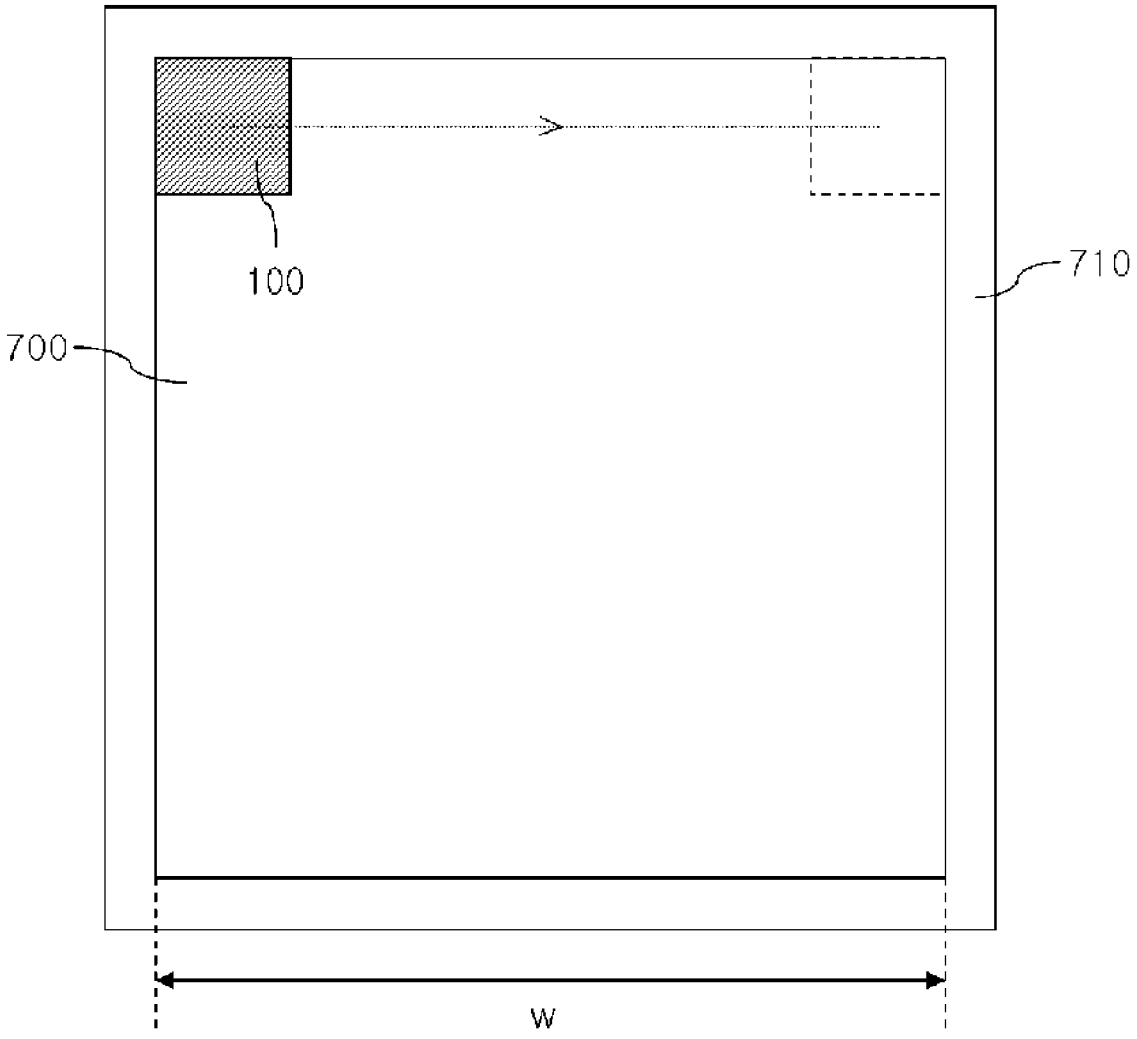

FIGS. 19 and 20 are views illustrating a method of measuring a width of a window according to an embodiment.

Referring to FIG. 19, a window frame 710 for fixing a window 700 may be disposed on an outer area of the window 700. Thus, when a window cleaning apparatus 10 is moved up to an end of one side of the window 700, the window cleaning apparatus 10 may collide to contact the window frame 710.

According to an embodiment, when a user requests starting of cleaning after the window cleaning apparatus 10 is attached to the window 700, the window cleaning apparatus 10, i.e., a first cleaning unit 100 attached to an inner surface of the window 700 may be moved upward from the attached position.

For example, the first cleaning unit 100 may vertically ascend from the attached position and be moved up to an upper end of the window 700. When a buffer member provided in the first cleaning unit 100 collides with the window frame 710 to contact the window frame 710 of the window 700, it may be determined that the first cleaning unit 100 is moved up to the upper end of the window 700.

In more detail, when an upper bumper collides with the window frame 710 during the vertical ascent of the first cleaning unit 100 so that a sensor detects a pressure from the upper side, the upward movement of the first cleaning unit 100 may be finished.

As described above, when the first cleaning unit 100 vertically ascends, a detergent may be injected through a detergent injection port 631 of the second cleaning unit 200 to wet a pad 631 provided in a cleaning module 630.

Thereafter, the first cleaning unit 100 is horizontally moved in a left direction and moved up to a right end of the window. When the buffer member of the first cleaning unit 100 collides with a right window frame 710 to contact the right window frame 710, it may be determined that the first cleaning unit 100 is moved up to the right end of the window.

In more detail, when a bumper collides with the window frame 710 during the left horizontal movement of the first cleaning unit 100 so that the sensor detects a pressure from the left side, the left movement of the first cleaning unit 100 may be finished.

Thus, after the first cleaning unit 100 is attached by the user, the first cleaning unit 100 may be moved to the uppermost left end of the window 700 according to the above-described movement.

Referring to FIG. 20, the first cleaning unit 100 may be horizontally moved in a right direction from the uppermost left end of the window 700 up to a left end of the window. When the buffer member of the first cleaning unit 100 collides with a left window frame 710 to contact a left window frame 710, it may be determined that the first cleaning unit 100 is moved up to the left end of the window.

In more detail, when a bumper collides with the window frame 710 during the right horizontal movement of the first cleaning unit 100 so that the sensor detects a pressure from the right side, the right movement of the first cleaning unit 100 may be finished.

As shown in FIG. 20, the first cleaning unit 100 may be moved from the uppermost left end of the window 700 to the right end to measure a width w of the window 70. For example, the width w of the window 70 may be measured by a rotation degree of each of first wheel members 120 disposed on the first cleaning unit 100.

According to an embodiment, after the width w of the window 700 is measured, a moving path of the window cleaning apparatus 10, i.e., the first cleaning unit 100 may be decided on the basis of the measured width w.

For example, when the measured width w of the window 700 is less than a preset reference value, as shown in FIG. 18, the moving path may be set so that the path, i.e., the right downward section 810 and the left downward section 820 are alternately and repeatedly defined.

Also, when the measured width w of the window 700 is greater than the reference value, the dropping may be compensated by the gravity of the window cleaning apparatus 10 including the upward section in which the moving path is defined in right or left upward directions.

Figure 29:
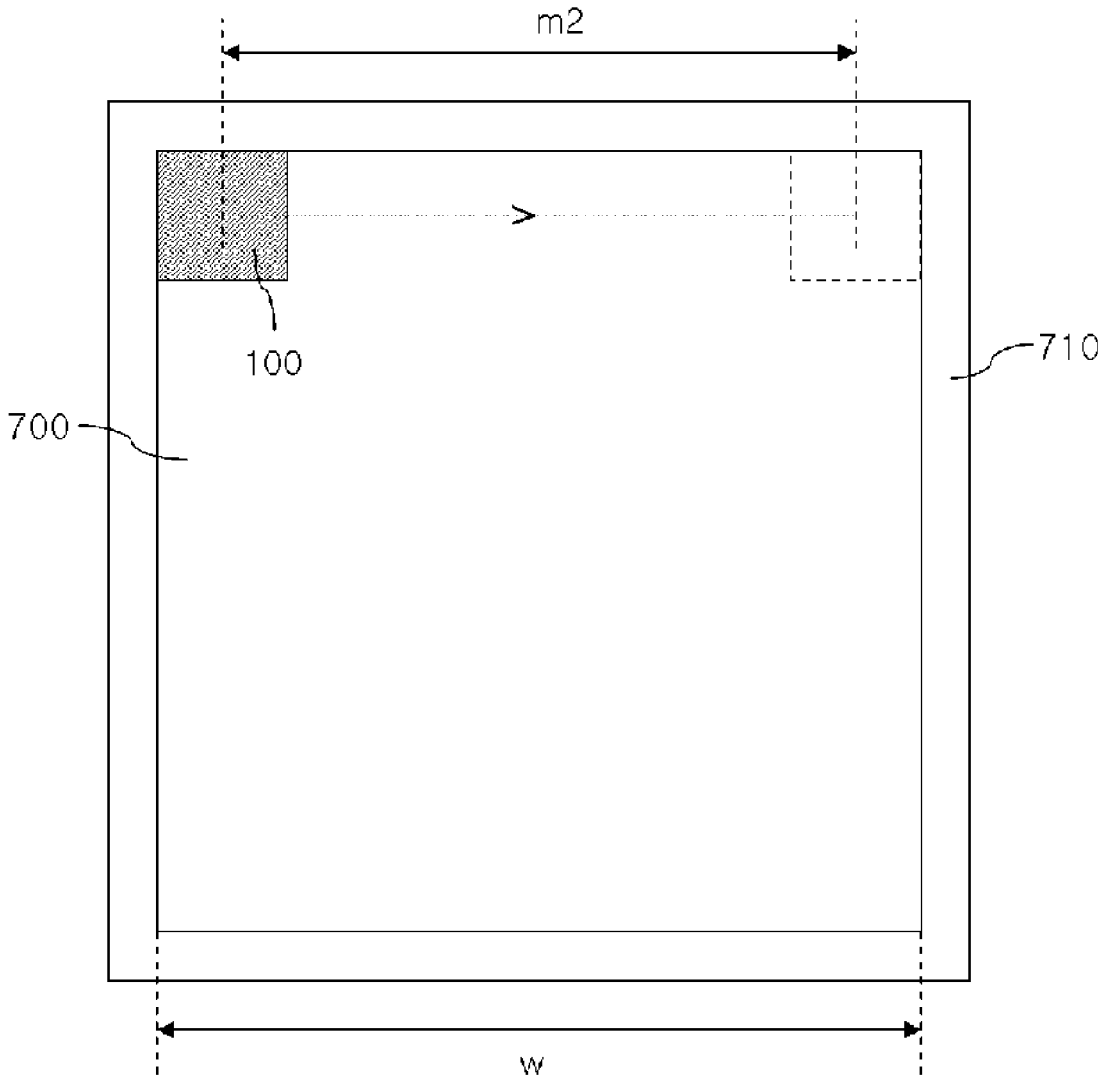

Referring to FIGS. 19 and 20, although the window cleaning apparatus 10 is moved to measure the width w of the window 700 with reference to FIGS. 19 and 29, the present disclosure is not limited thereto. For example, the width w of the window 700 may be inputted by the user.

Figure 21:
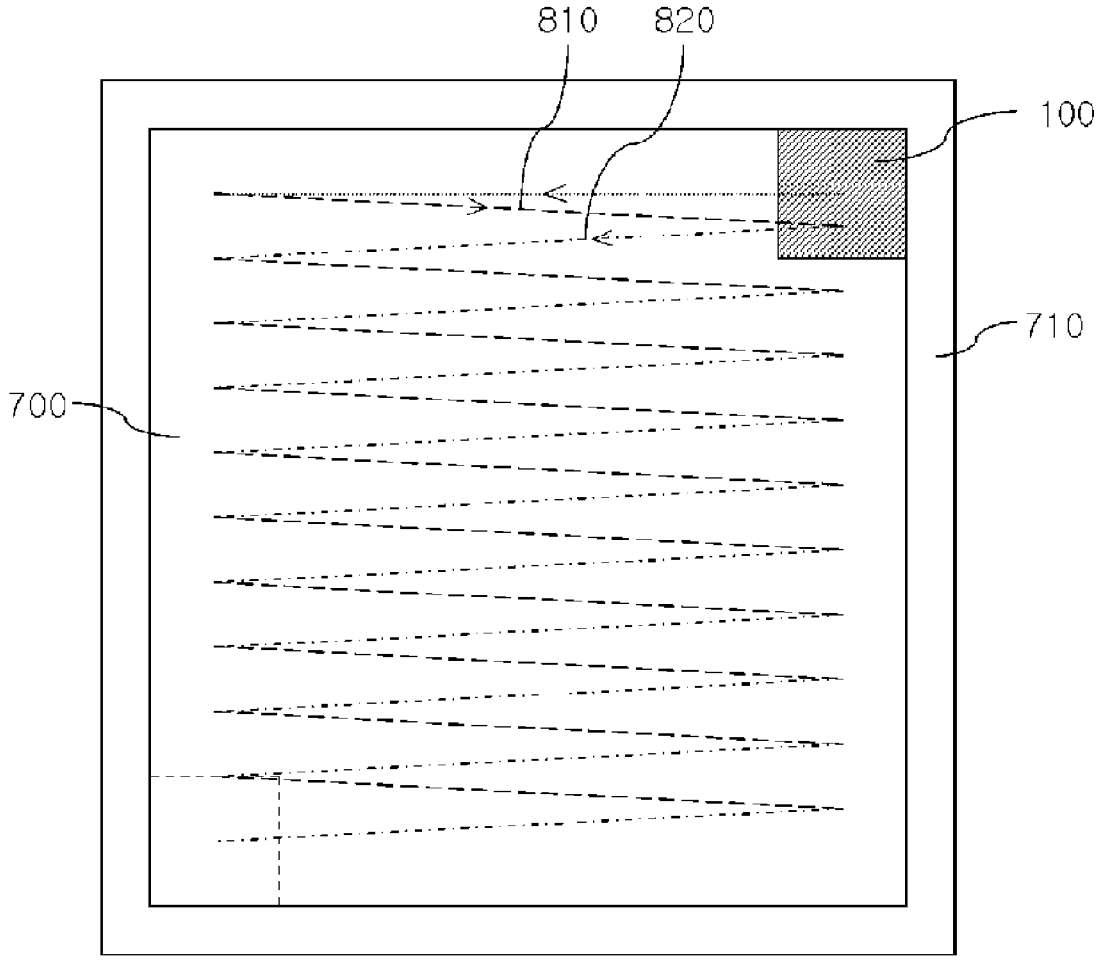
FIG. 21 is a view illustrating a moving path of the window cleaning apparatus when the window has a width less than a reference value according to an embodiment.

FIG. 21 is a view illustrating a movement path of the window cleaning apparatus when the window has a width less than a reference value according to an embodiment.

Referring to FIG. 21, when the width w of the window 700 is less than the reference value, e.g., about 1 m, the first cleaning unit 100 may be horizontally moved up to the left end of the window 700.

Since the first cleaning unit 100 is horizontally moved in the right direction as shown in FIG. 20 and moved in the left direction as shown in FIG. 21, the cleaning may be performed two times at the upper end of the window 700. Thus, dusts existing on a portion adjacent to the window frame 710 may be more cleanly removed.

After the first cleaning unit 100 is moved up to the uppermost left end of the window 700, the first cleaning unit 100 is moved downward up to the right end of the window 700 in the right direction and then moved downward up to the left end of the window 700 in the left direction.

That is, when the width w of the window 700 is less than the reference value, e.g., about 1 m, the first cleaning unit 100 is alternately and repeatedly moved in the right downward section 810 and the left downward section 820.

Figure 22:
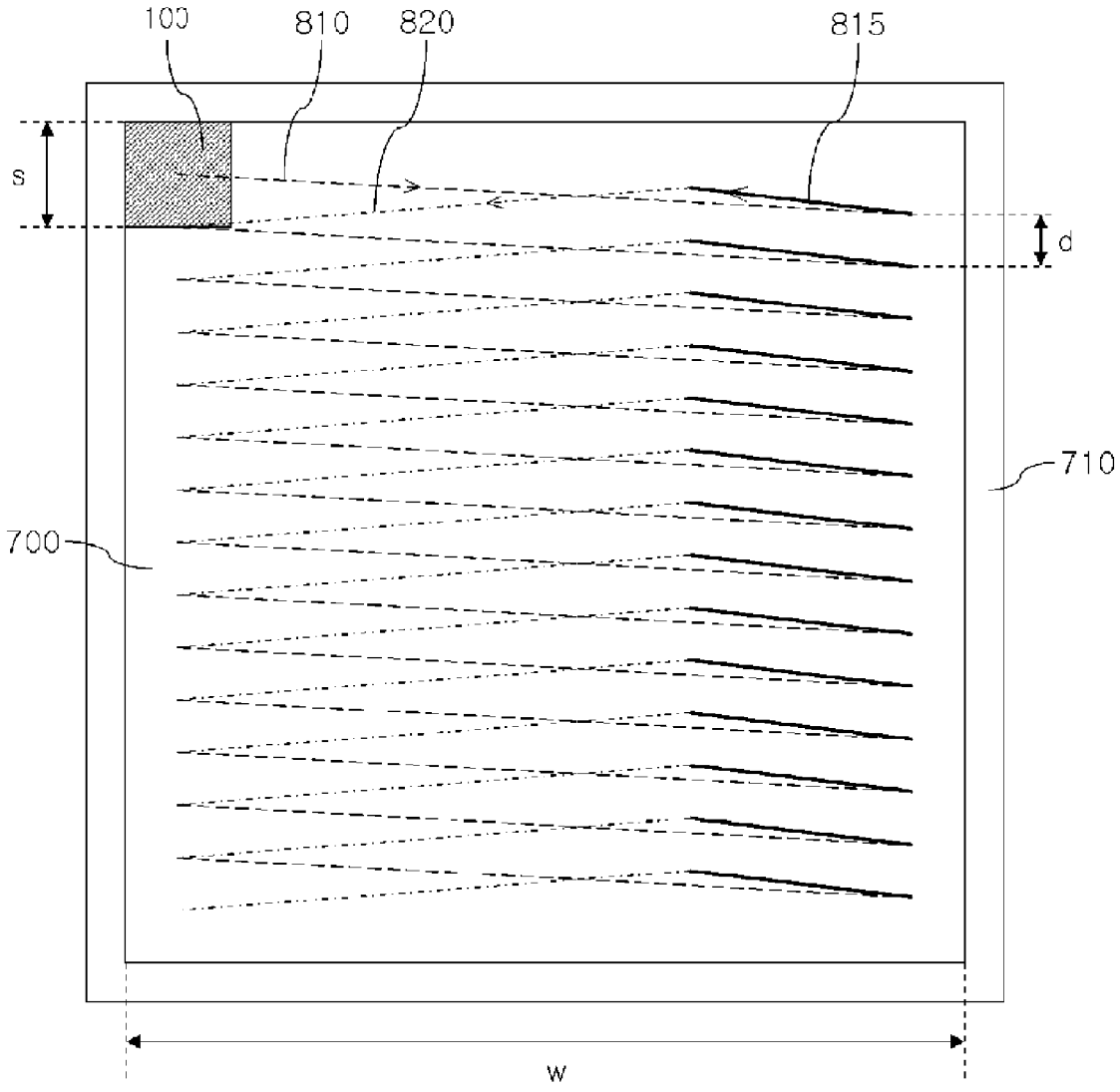
FIG. 22 is a view illustrating a moving path of the window cleaning apparatus when the window has a width greater than the reference value according to an embodiment.

FIG. 22 is a view illustrating a movement path of the window cleaning apparatus when the window has a width greater than the reference value according to an embodiment.

Referring to FIG. 22, when the width w of the window 700 is greater than the reference value, e.g., about 1 m, the first cleaning unit 100, i.e., a moving path of the first cleaning unit 100 may include an upward section 815 in which the first cleaning unit 100 is moved upward in a specific direction.

For example, the first cleaning unit 100 disposed at the uppermost left end of the window 700 is moved downward up to the right end of the window 700 in the right direction. Then, after the first cleaning unit 100 is moved upward in the left direction for a predetermined time, the first cleaning unit 100 may be moved downward up to the left end of the window 700 in the left direction.

That is, when the width w of the window 700 is greater than the reference value, e.g., about 1 m, the first cleaning unit 100 is alternately and repeatedly moved in the right downward section 810, the left upward section 815, and the left downward section 820.

As described above, the moving path of the first cleaning unit 100 includes the upward section 815, the dropping of the window cleaning apparatus 10 due the window 700 having the width w greater than the reference value may be compensated. Thus, the preset value of the vertical distance d of the moving path, e.g., the value of about ½ of the size s of the window cleaning apparatus 10, or the value set by the user may be maintained.

Figure 23:
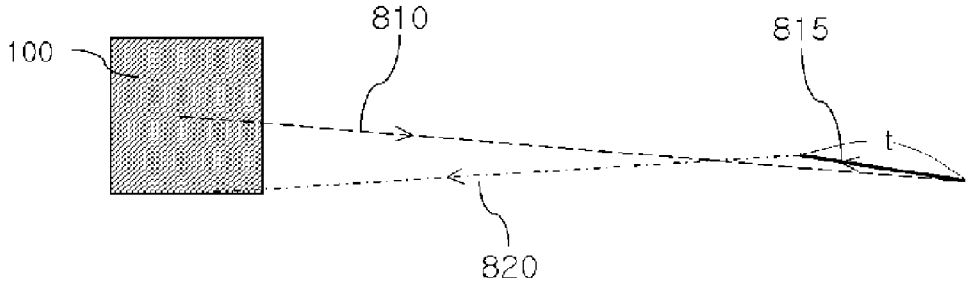
FIGS. 23 and 24 are views illustrating an upward section of the moving path of the window cleaning apparatus according to embodiments.
Figure 24:
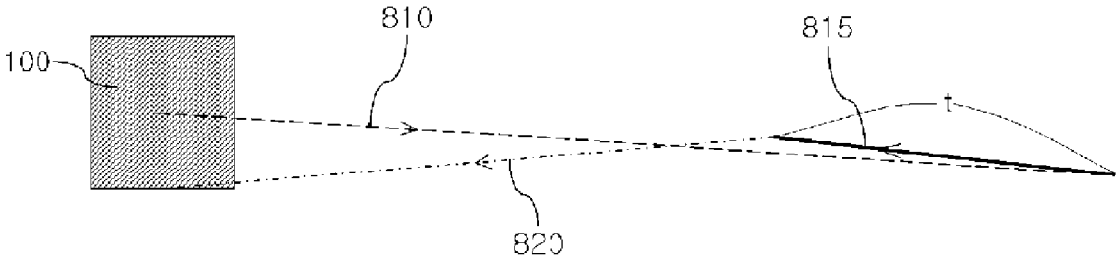

FIGS. 23 and 24 are views illustrating an upward section of the movement path of the window cleaning apparatus according to embodiments.

Referring to FIG. 23, when the width w of the window 700 is greater than the reference value, the moving path of the first cleaning unit 100 may include the right downward section 810, the left upward section 815, and the left downward section 820 in order. Thus, the first cleaning unit 100 may be moved upward in the left direction for a predetermined time t within the left upward section 815.

A moving time t in the left upward section 815 may be set according to the width w of the window 700. For example, the more the width w of the window 700, the more the moving time t in the left upward section 815 is increased. Thus, the dropping of the window cleaning apparatus 10 may be effectively compensated.

That is, the more the width w of the window 700 is increased, the more a dripping distance of the window cleaning apparatus 10 is increased. Thus, if it is assumed that an upward moving angle is constant, when the moving time t in the left upward section 815 is increased, the upward movement of the first cleaning unit 100 may be increased to compensate the increased dropping distance.

According to an embodiment, the moving time t in the left upward section 815 may be set in proportion to a difference between the width w of the window 700 and the reference value (e.g., about 1 m).

For example, the moving time t in the left upward section 815 may be calculated by following Equation 1 according to the width w of the window 700.

$$t=k(w-r) \qquad \text{[Equation 1]}$$

In Equation 1, the reference symbol r is a reference value with respect to the width w of the window 700, for example, about 1. Also, the reference symbol k is a proportional constant.

According to another embodiment, a lookup table may be prepared to allow the width w of the window 700 and the moving time t in the left upward section 815 to correspond to each other. Then, the lookup table may be stored in the window cleaning apparatus 10. Thus, the moving time t in the left upward section may be obtained with reference to the lookup table according to the measured width w of the window 700.

Referring to FIG. 24, the more the width w of the window 700 is increased, the more the moving time t in the left upward section 815 in which the first cleaning unit 100 is moved upward in the left direction may be increased. Thus, the moving distance in the left upward section 815 may be increased.

Figure 25:
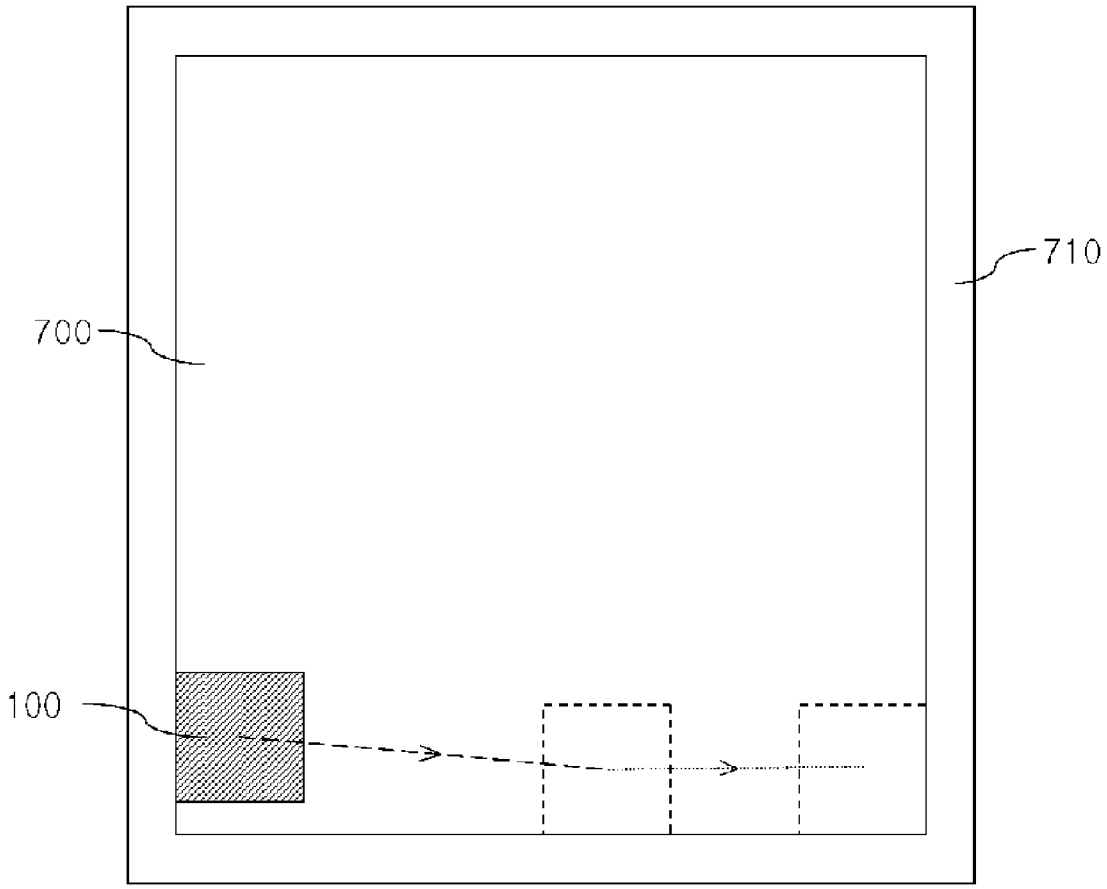
FIGS. 25 and 26 are views illustrating a cleaning finishing method of the window cleaning apparatus according to an embodiment.
Figure 26:
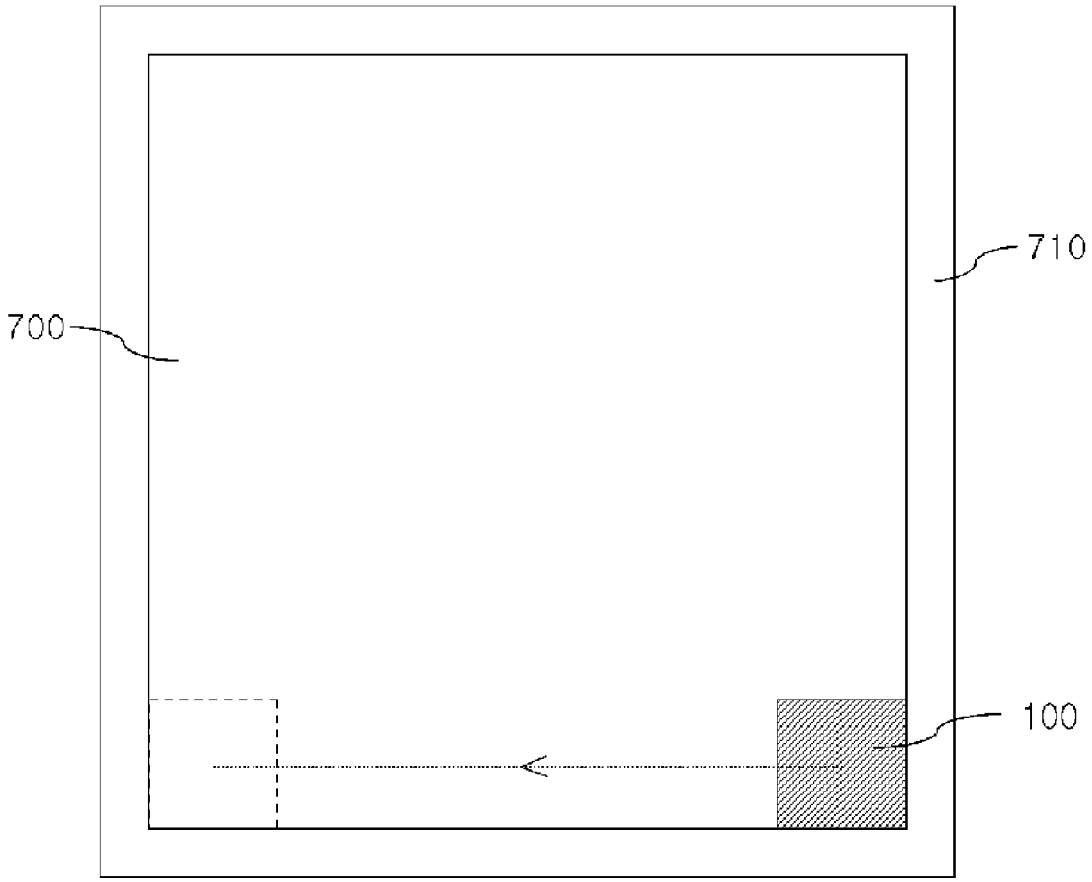

FIGS. 25 and 26 are views illustrating a cleaning finishing method of the window cleaning apparatus according to an embodiment.

Referring to FIG. 25, when the first cleaning unit 100 reaches a lower end of the window 700 during the left downward movement of the first cleaning unit 100 along the moving path decided on the basis of the width w of the window 700, the window cleaning process may be finished.

For example, when the buffer member of the first cleaning unit 100 collides with the lower window frame 710 to contact the lower window frame 710 during the right downward movement of the first cleaning unit 100, it may be determined that the first cleaning unit 100 is moved up to the lower end of the window 700.

In more detail, when a lower bumper of the first cleaning unit 100 collides with the window frame 710 so that a sensor detects a pressure from the lower side for a predetermined time or more, it may be recognized as a cleaning finishing time point.

As described above, when the first cleaning unit 100 is moved up to the lower end of the window 700 so that the cleaning finishing time point is recognized, the first cleaning unit 100 is horizontally moved in the right direction along the lower window frame 710. Thus, the first cleaning unit 100 may be moved up to the right end of the window 700, and the detergent injection of the second cleaning unit 200 may be completed at the horizontal moving time point in the right direction.

Referring to FIG. 26, after the first cleaning unit 100 is moved up to the right end of the window 700, the first cleaning unit 100 may be horizontally moved in left direction along the lower window frame 710 and then moved up the left end of the window 700.

After the detergent injection is completed as described above, the detergent flowing down during the cleaning to remain on the lower end of the window 700 may be clearly removed.

When the movement and cleaning of the window cleaning apparatus 10 is completed as described above, the window cleaning apparatus 10, i.e., the first cleaning unit 100 may return to a position at which the user may easily separate the window cleaning apparatus 10 from the window 700.

Although the method of controlling the movement of the window cleaning apparatus including the first and second cleaning units 100 and 200 respectively attached on the inner and outer surfaces of the window by the magnetic force is described as an example, the present disclosure is not limited thereto. For example, the method may be applied to a window cleaning apparatus which is attached to one surface of the inner and outer surfaces of the window 700 or a window cleaning apparatus attached to the window 700 through vacuum absorption except for the magnetic force.

According to an embodiment, the window cleaning apparatus may return to and stay at a position at which the user may easily separate the window cleaning apparatus from the window 70, i.e., a position adjacent to the position at which the user attaches the window cleaning apparatus to the window 70.

For example, an initial attached position of the window cleaning apparatus may be detected at a time point at which the user attaches the window cleaning apparatus to the window 700 to clean the window 700. After the cleaning is finished, the window cleaning apparatus may be moved at a position adjacent to the detected attachment position of the left end and right end of the window 700. Thus, after the cleaning is finished, the user may easily separate the window cleaning apparatus.

Figure 27:
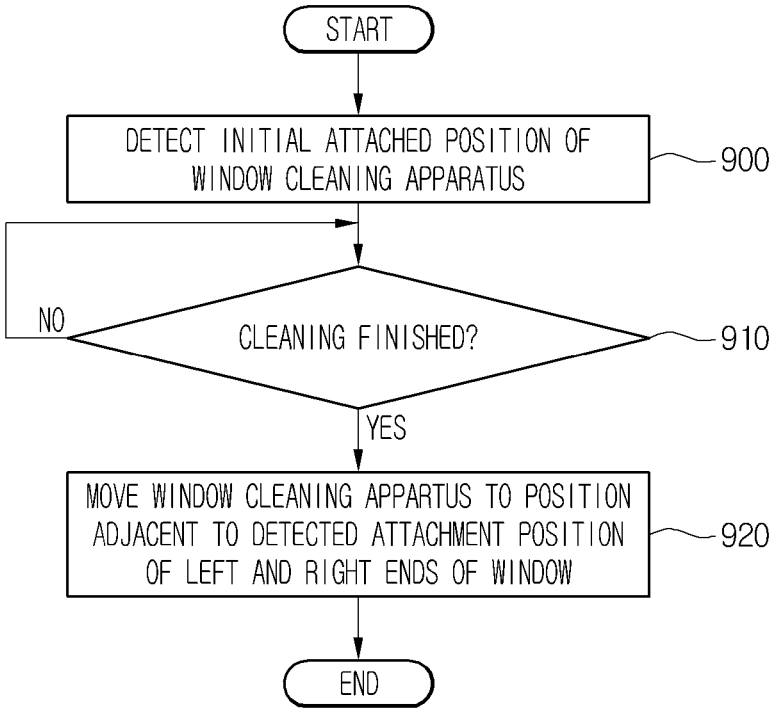
FIG. 27 is a flowchart illustrating a method of controlling a movement of a window cleaning apparatus according to another embodiment.

FIG. 27 is a flowchart illustrating a method of controlling a window cleaning apparatus according to an embodiment. The moving control method may be performed by a window cleaning apparatus, i.e., a control module (not shown) provided in the window cleaning apparatus.

Referring to FIG. 27, the control module detects an initial attached position of the window cleaning apparatus in operation S900.

For example, when a user requests starting of cleaning after the window cleaning apparatus is attached to the window, the control module may determine whether the initial attached position of the window cleaning apparatus is defined at a left or right side of the window.

Thereafter, the window cleaning apparatus performs the cleaning while being moved along a preset moving path.

The control module determines whether the window cleaning is finished in operation S910. When the cleaning is finished, the window cleaning apparatus is moved at a position of the left and right end of the window adjacent to the detected attachment position in operation S920.

For example, in a case where it is determined that the initial attached position of the window cleaning apparatus is defined at the left side of the window in the operation S900, the control module may move the window cleaning apparatus up to the left end of the window after the cleaning is finished.

On the other hand, when it is determined that the initial attached position of the window cleaning apparatus is defined at the right side of the window, the control module may move the window cleaning apparatus up to the right end of the window after the cleaning is finished.

That is, since a position at which the user attaches the window cleaning apparatus may be a position at which the user may easily separate the window cleaning apparatus from the window, the window cleaning apparatus may return to and stay at the initial attached position after the cleaning is finished. Thus, the user may easily separate the window cleaning apparatus from the window.

When the cleaning is not finished, the control module may continuously move the window cleaning apparatus along the moving path.

According to an embodiment, the window cleaning apparatus may be gradually moved from the upper end of the window up to the lower end to perform the cleaning. In this case, when the window cleaning apparatus is moved up to the lower end of the window, it may be determined that the cleaning is finished.

Hereinafter, a method of controlling a movement of a window cleaning apparatus 10 will be described in detail with reference to FIGS. 28 to 37.

A case in which a first cleaning unit 100 attached to an inner surface in first and second cleaning units 100 and 200 included in a window cleaning apparatus 10 is moved by the movement control method according to an embodiment will be described as an example.

Figure 28:
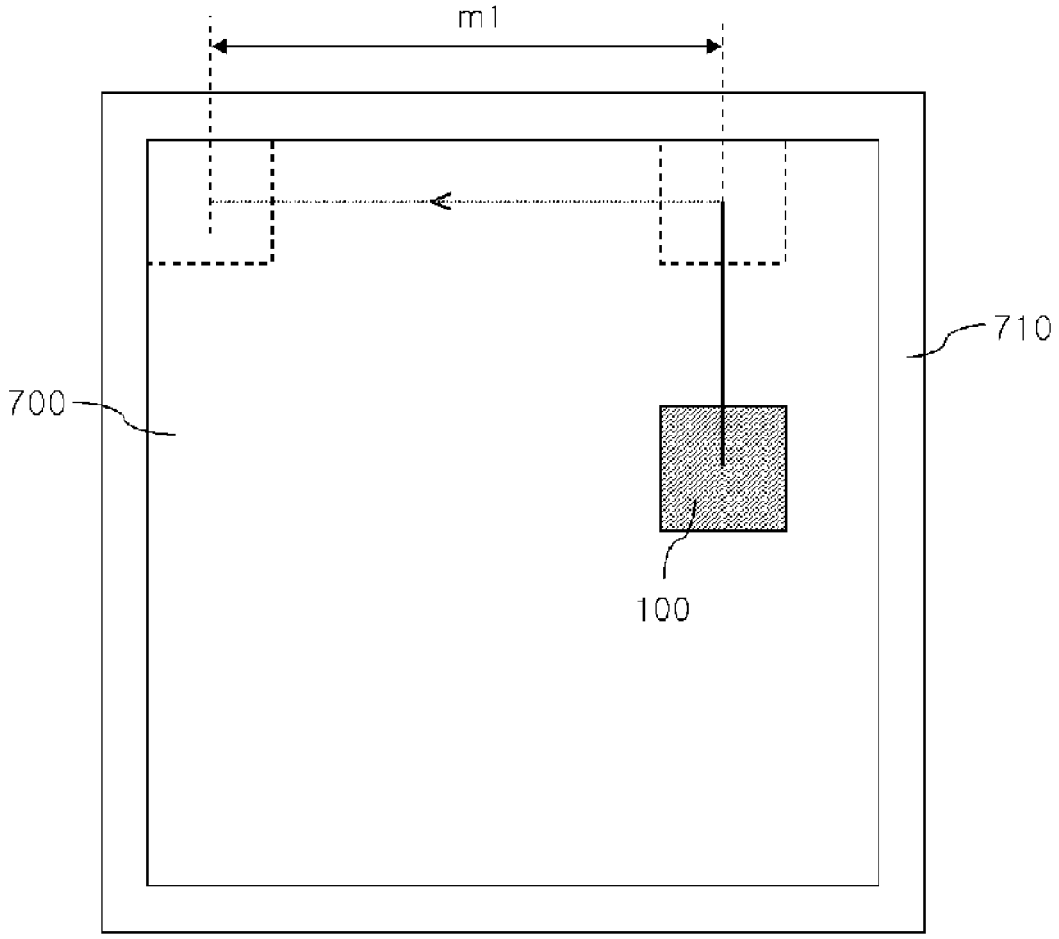
FIGS. 28 and 29 are views illustrating a method of detecting an initial attached position of the window cleaning apparatus according to an embodiment.

FIGS. 28 and 29 are views illustrating a method of detecting an initial attached position of the window cleaning apparatus according to an embodiment.

Referring to FIG. 28, a window frame 710 for fixing a window 700 may be disposed on an outer area of the window 700. Thus, when a window cleaning apparatus 10 is moved up to an end of one side of the window 700, the window cleaning apparatus 10 may collide to contact the window frame 710.

According to an embodiment, when a user requests a cleaning time after the window cleaning apparatus 10 is attached to the window 700, the window cleaning apparatus 10, i.e., a first cleaning unit 100 attached to an inner surface of the window 700 may be moved upward from the attached position.

For example, the first cleaning unit 100 may vertically ascend from the attached position and be moved up to an upper end of the window 700. When a buffer member provided in the first cleaning unit 100 collides with the window frame 710 to contact the window frame 710 of the window 700, it may be determined that the first cleaning unit 100 is moved up to the upper end of the window 700.

In more detail, when an upper bumper collide with the window frame 710 during the vertical ascent of the first cleaning unit 100 so that a sensor detects a pressure from the upper side, the upward movement of the first cleaning unit 100 may be finished.

As described above, when the first cleaning unit 100 vertically ascends, a detergent may be injected through a detergent injection port 931 of the second cleaning unit 200 to wet a pad 930 provided in a cleaning module 931.

Thereafter, the first cleaning unit 100 is horizontally moved in a left direction and moved up to a right end of the window. When the buffer member of the first cleaning unit 100 collides with a right window frame 710 to contact the right window frame 710, it may be determined that the first cleaning unit 100 is moved up to a right end of the window.

In more detail, when a bumper collides with the window frame 710 during the left horizontal movement of the first cleaning unit 100 so that the sensor detects a pressure from the left side, the left movement of the first cleaning unit 100 may be finished.

Thus, after the first cleaning unit 100 is attached by the user, the first cleaning unit 100 may be moved to the uppermost left end of the window 700 according to the above-described movement.

Referring to FIG. 28, a first moving distance ml may be measured during the left horizontal movement of the first cleaning unit 100. For example, the first moving distance ml may be measured by a rotation rate of first wheel members 120 disposed on the first cleaning unit 100.

Referring to FIG. 29, the first cleaning unit 100 may be horizontally moved in a right direction from the uppermost left end of the window 700 up to a right end of the window. When a buffer member of the first cleaning unit 100 collides with the left window frame 710 to contact the right window frame 710, it may be determined that the first cleaning unit 100 is moved up to the left end of the window.

In more detail, when a bumper collides with the window frame 710 during the right horizontal movement of the first cleaning unit 100 so that the sensor detects a pressure from the right side, the right movement of the first cleaning unit 100 may be finished.

Figure 30:
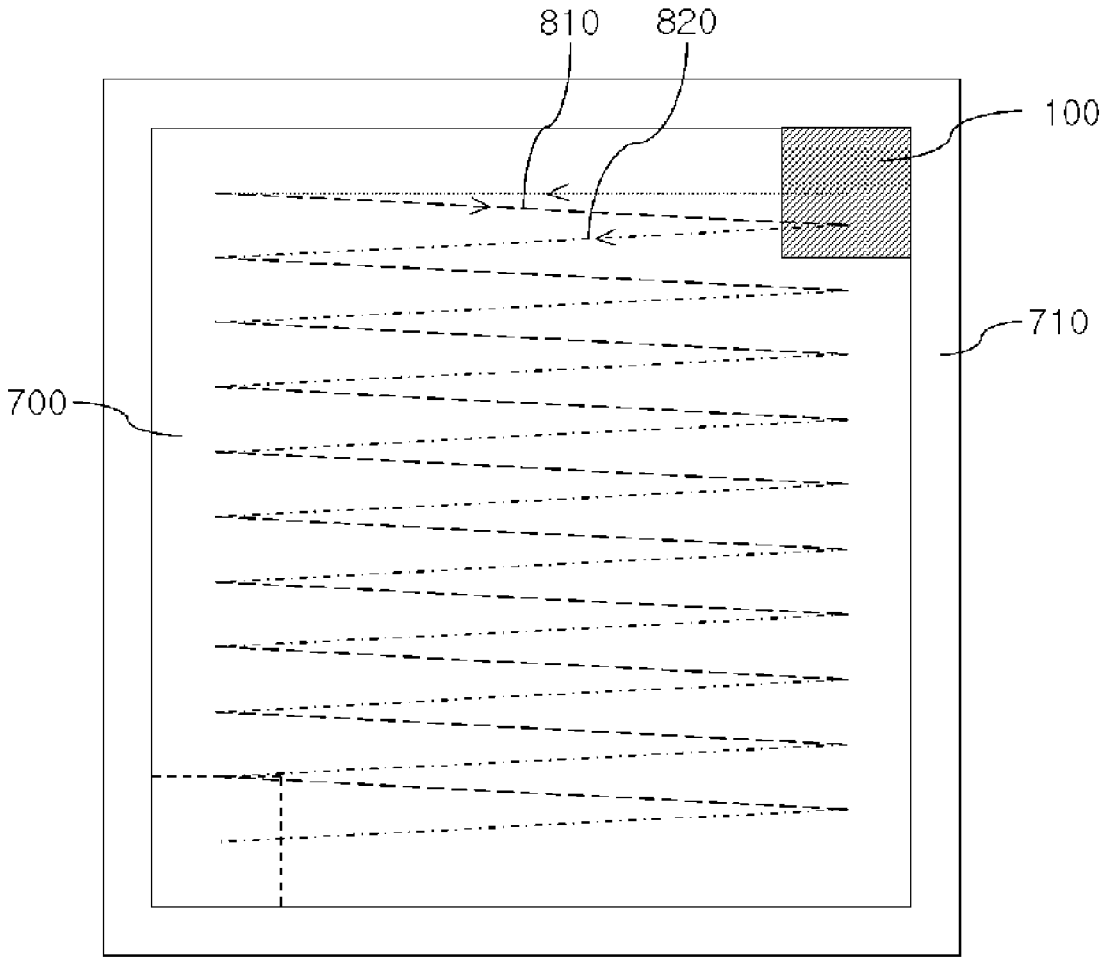
FIG. 30 is a view illustrating a moving path of the window cleaning apparatus according to an embodiment.

Referring to FIG. 30, a second moving distance m2 may be measured when the first cleaning unit 100 is moved from the uppermost left end up to a right end of the window 700. For example, the second moving distance m2 may be measured by the rotation rate of the first wheel members 120 disposed on the first cleaning unit 100.

According to an embodiment, after the first moving distance m1 and the second moving distance m2 are measured, the first and second moving distances m1 and m2 may be compared to each other to detect an initial attached position of the window cleaning apparatus.

Referring to FIGS. 28 and 29, since the first moving distance m1 is greater by about ½ than the second moving distance m2, it may be determined that the initial attached position of the window cleaning apparatus is defined at the right side of the window 700.

Thus, after the cleaning is finished, the window cleaning apparatus, i.e., the first cleaning unit 100 may be moved to and stay at the right end of the window. Thus, the user may easily separate the first and second cleaning units 100 and 200 from the window 700.

On the other hand, when the first moving distance m1 is less by about ½ than the second moving distance m2, it may be determined that the initial attached position of the window cleaning apparatus is defined at the left side of the window. Thus, after the cleaning is finished, the first cleaning unit 100 may be moved to and stay at the left end of the window.

According to another embodiment, the first clean unit 100 may vertically ascend from the initial attached position and then be moved up to the right end of the window by a third moving distance m3. Then, the first clean unit 100 may be moved from the right end of the window up to the left end and then moved by a fourth moving distance m4.

In this case, when the third moving distance m3 is greater by about ½ than the fourth moving distance m4, it may be determined that the initial attached position of the window cleaning apparatus is defined at the left side of the window 700.

On the other hand, when third moving distance m3 is less by about ½ than the fourth moving distance m4, it may be determined that the initial attached position of the window cleaning apparatus is defined at the right side of the window 700.

FIG. 30 is a view illustrating a moving path of the window cleaning apparatus.

Referring to FIG. 30, since the first cleaning unit 100 is horizontally moved in the right direction as shown in FIG. 29 and moved in the left direction as shown in FIG. 30, the cleaning may be performed two times at the upper end of the window 700. Thus, dusts existing on a portion adjacent to the window frame 710 may be more cleanly removed.

After the first cleaning unit 100 is moved up to the uppermost left end of the window 700, the first cleaning unit 100 is moved downward up to the right end of the window 700 in the right direction and then moved downward up to the left end of the window 700 in the left direction.

That is, the moving path of the first cleaning unit 100 may alternately repeat a light downward section 810 in which the first cleaning unit 100 is moved downward in a right direction and a left downward section 820 in which the first cleaning unit 100 is moved downward in a left direction.

Figure 31:
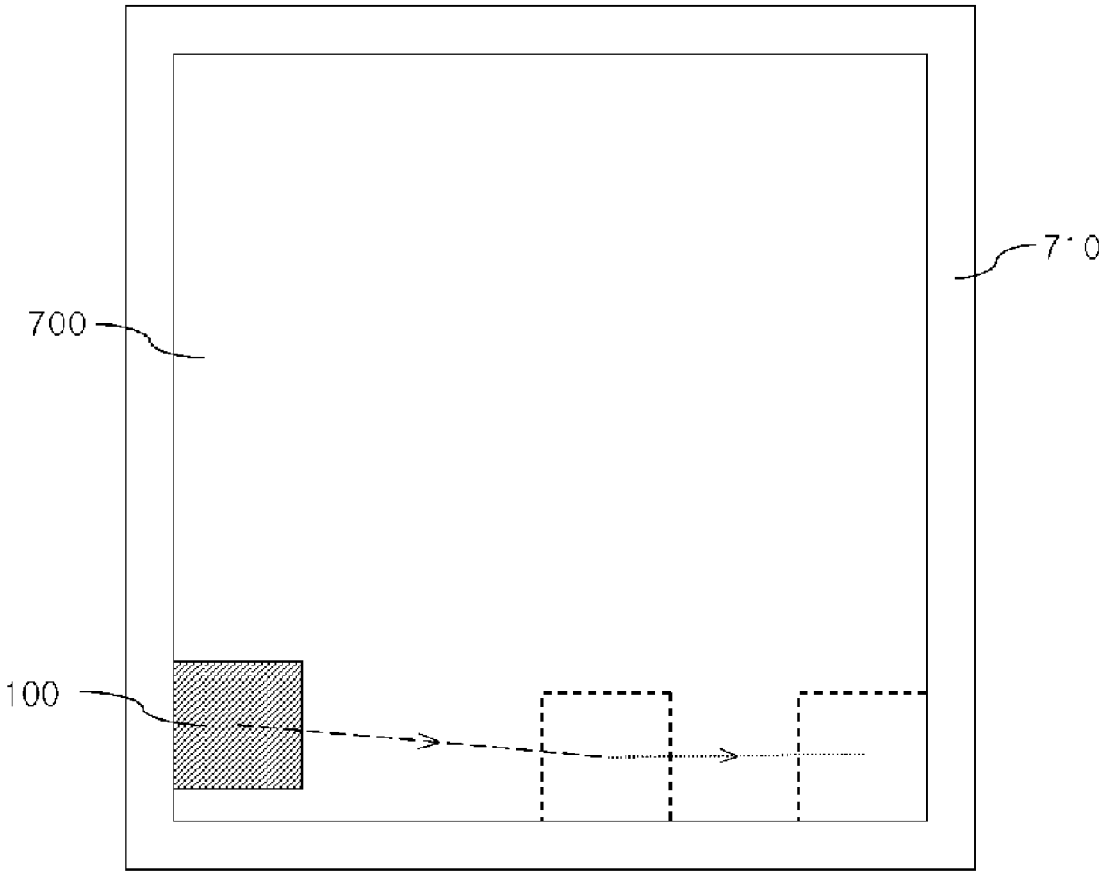
FIGS. 31 and 32 are views illustrating a cleaning finishing method of the window cleaning apparatus according to an embodiment.
Figure 32:
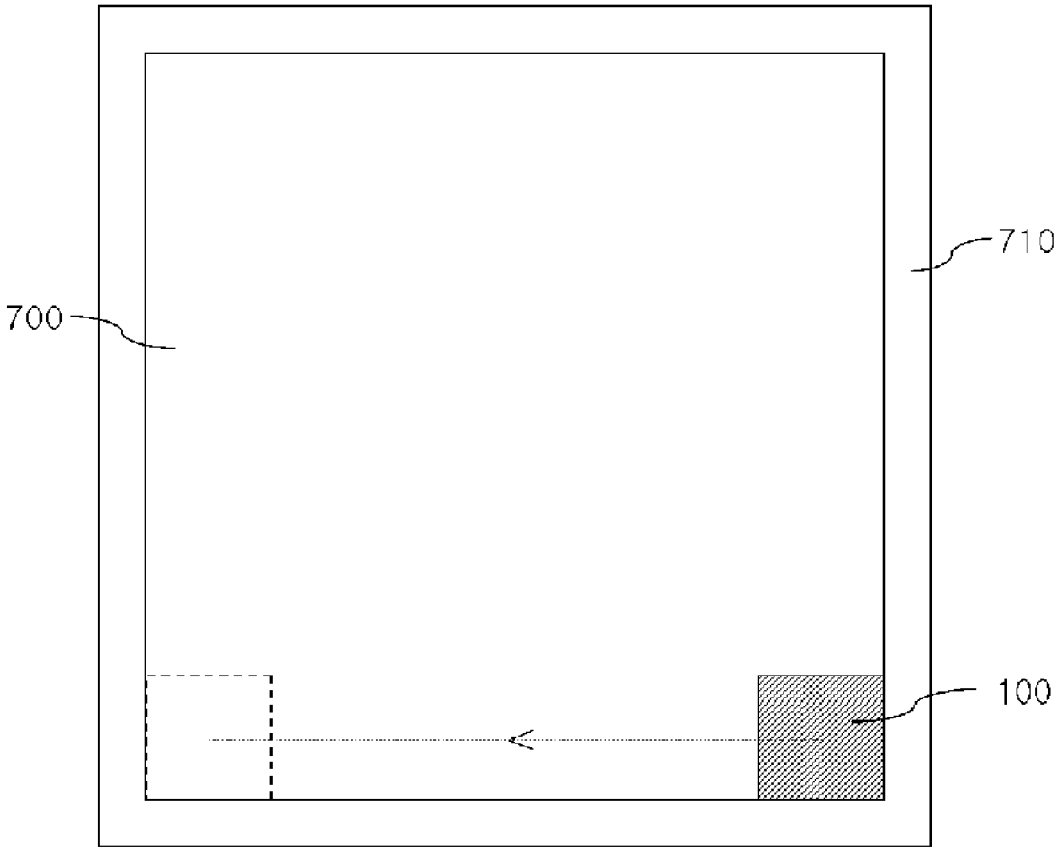

FIGS. 31 and 32 are views illustrating a cleaning finish method of the window cleaning apparatus according to an embodiment.

Referring to FIG. 31, when the first cleaning unit 100 reaches a lower end of the window 700 during the left downward movement of the first cleaning unit 100 along the moving path decided on the basis of the width w of the window 700, the window cleaning process may be finished.

For example, when the buffer member of the first cleaning unit 100 collides with the lower window frame 710 to contact the lower window frame 710 during the right downward movement of the first cleaning unit 100, it may be determined that the first cleaning unit 100 is moved up to the lower end of the window 700.

In more detail, when a lower bumper of the first cleaning unit 100 collides with the window frame 710 so that a sensor detects a pressure from the lower side for a predetermined time or more, it may be recognized as a cleaning finish time point.

As described above, when the first cleaning unit 100 is moved up to the lower end of the window 700 so that the cleaning finishing time point is recognized, the first cleaning unit 100 is horizontally moved in the right direction along the lower window frame 710. Thus, the first cleaning unit 100 may be moved up to the right end of the window 700, and the detergent injection of the second cleaning unit 200 may be completed at the horizontal moving time point in the right direction.

Referring to FIG. 32, after the first cleaning unit 100 is moved up to the right end of the window 700, the first cleaning unit 100 may be horizontally moved in left direction along the lower window frame 710 and then moved up the left end of the window 700.

After the detergent injection is completed as described above, the detergent flowing down during the cleaning to remain on the lower end of the window 700 may be clearly removed.

When the cleaning of the window cleaning apparatus 10 is finished, the window cleaning apparatus 10, i.e., the first cleaning unit 100 may be moved to a position at which the user may easily separate the window cleaning apparatus 10 from the window 700, e.g., a position adjacent to the initial attached position.

Figure 33:
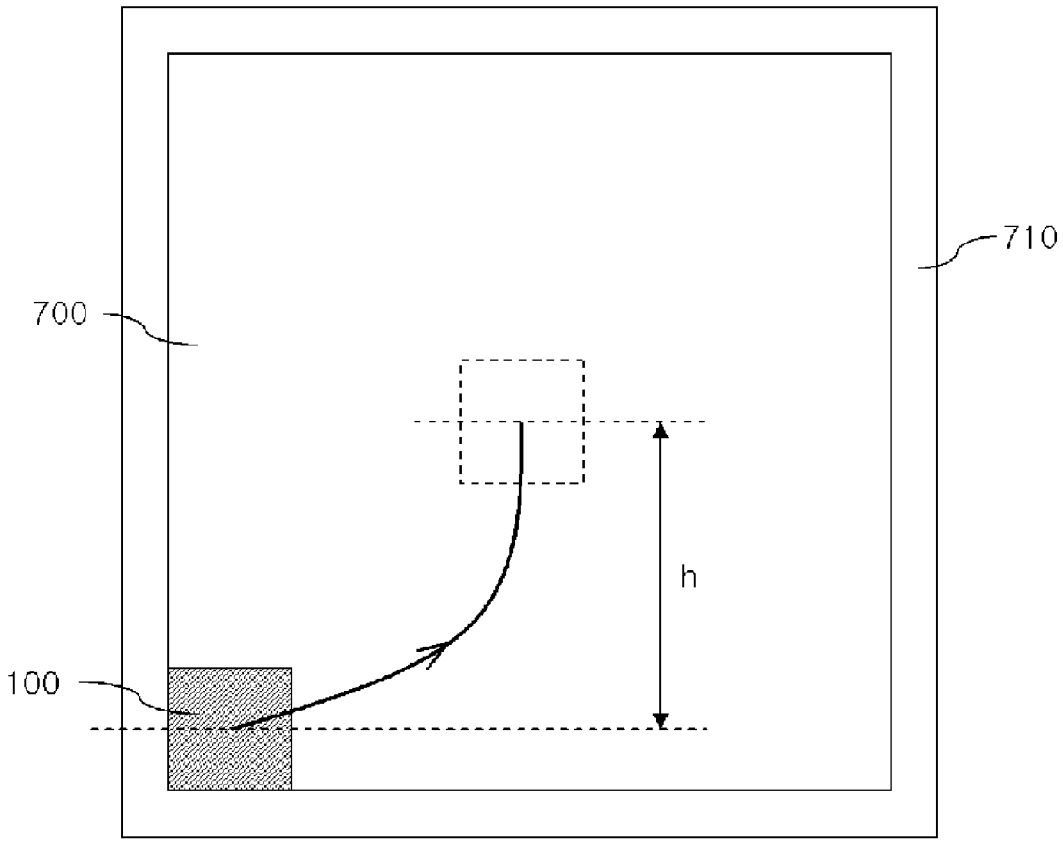
FIGS. 33 to 37 are views illustrating a moving path of the window cleaning apparatus after the cleaning is finished according to embodiments.
Figure 37:
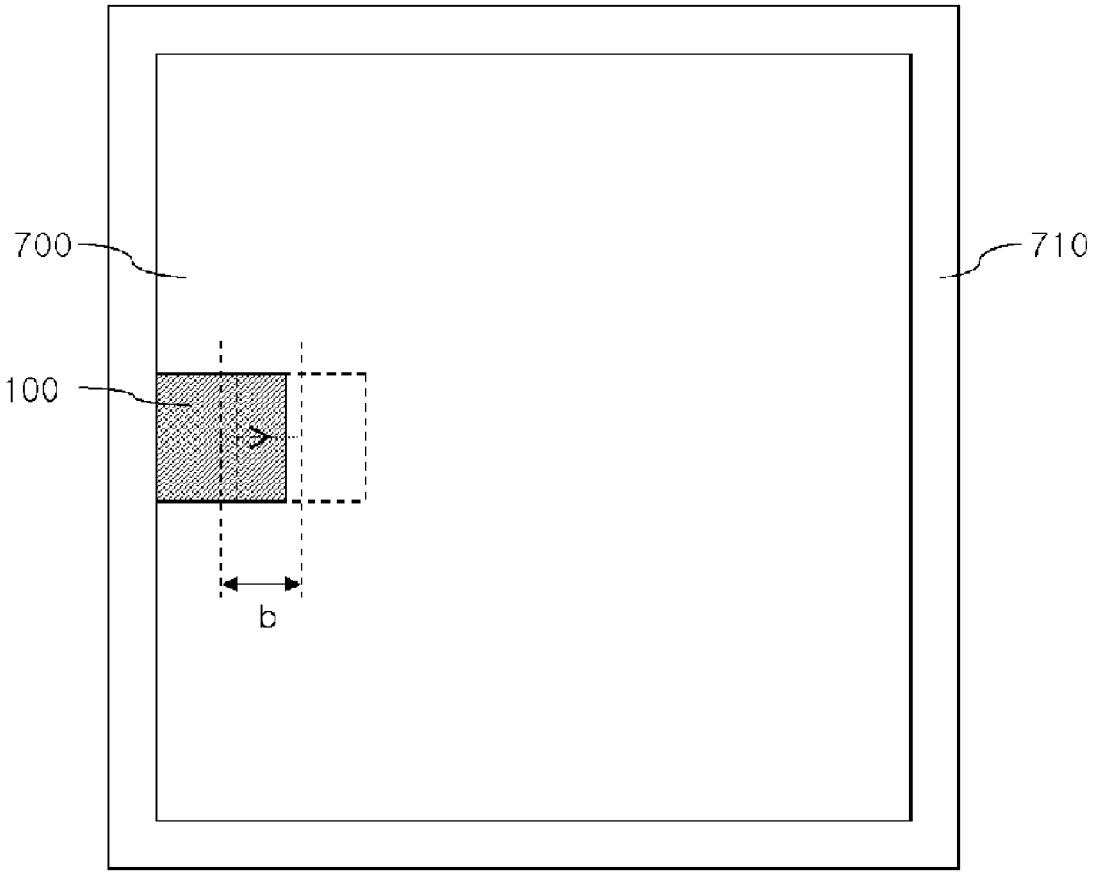

FIGS. 33 and 37 are views illustrating a movement path of the window cleaning apparatus after the cleaning is finished according to embodiments.

Referring to FIG. 33, when the first cleaning unit 100 is moved up to the left end of the window 700 to finish the cleaning as shown in FIG. 32, the first cleaning unit 100 may be moved upward by a certain distance h.

For example, after the cleaning is finished, the first cleaning unit 100 is moved upward with a path similar to a parabola in a right direction to ascend by the certain distance h.

When the first cleaning unit 100 is moved up to the right end of the window 700 to finish the cleaning, the first cleaning unit 100 is moved upward with a path similar to a parabola in a left direction to ascend by the certain distance h.

Thereafter, the first cleaning unit 100 may be moved toward an end adjacent to the detected initial attached position of the window cleaning apparatus of the left and right ends of the window 700.

Figure 34:
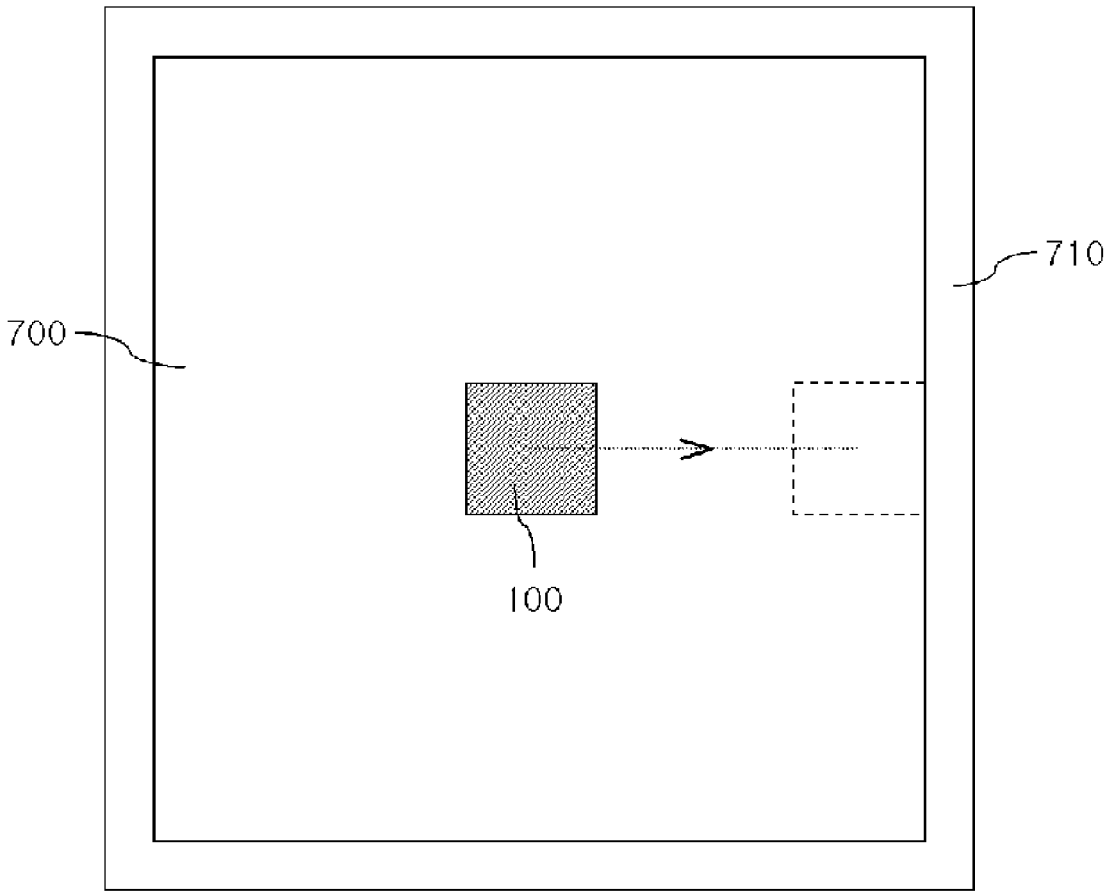

Referring to FIG. 34, when the initial attached position of the window cleaning apparatus is defined at the right side of the window 700, the first cleaning unit 100 may be horizontally moved up to the right end of the window 700 in the right direction.

Figure 35:
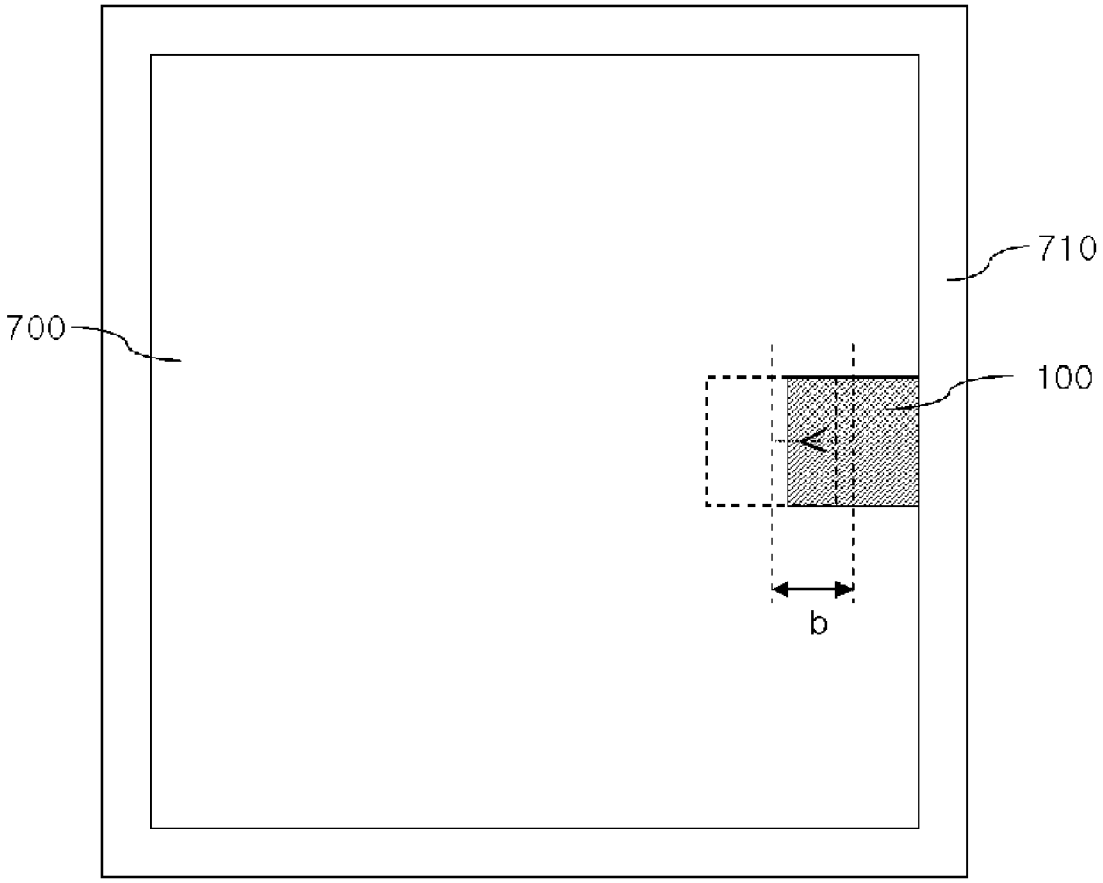

Referring to FIG. 35, after the first cleaning unit 100 is moved up to the right end of the window 700, the first cleaning unit 100 may be moved in an opposite direction, i.e., the left direction by a certain distance b.

After the cleaning is finished, since the first cleaning unit 100 is stopped at a position spaced the certain distance b from the right end of the window 700, the user may easily separate the window cleaning apparatus from the window. This is done because it is difficult to easily separate the window cleaning apparatus when the window cleaning apparatus contacts the window frame 710.

Figure 36:
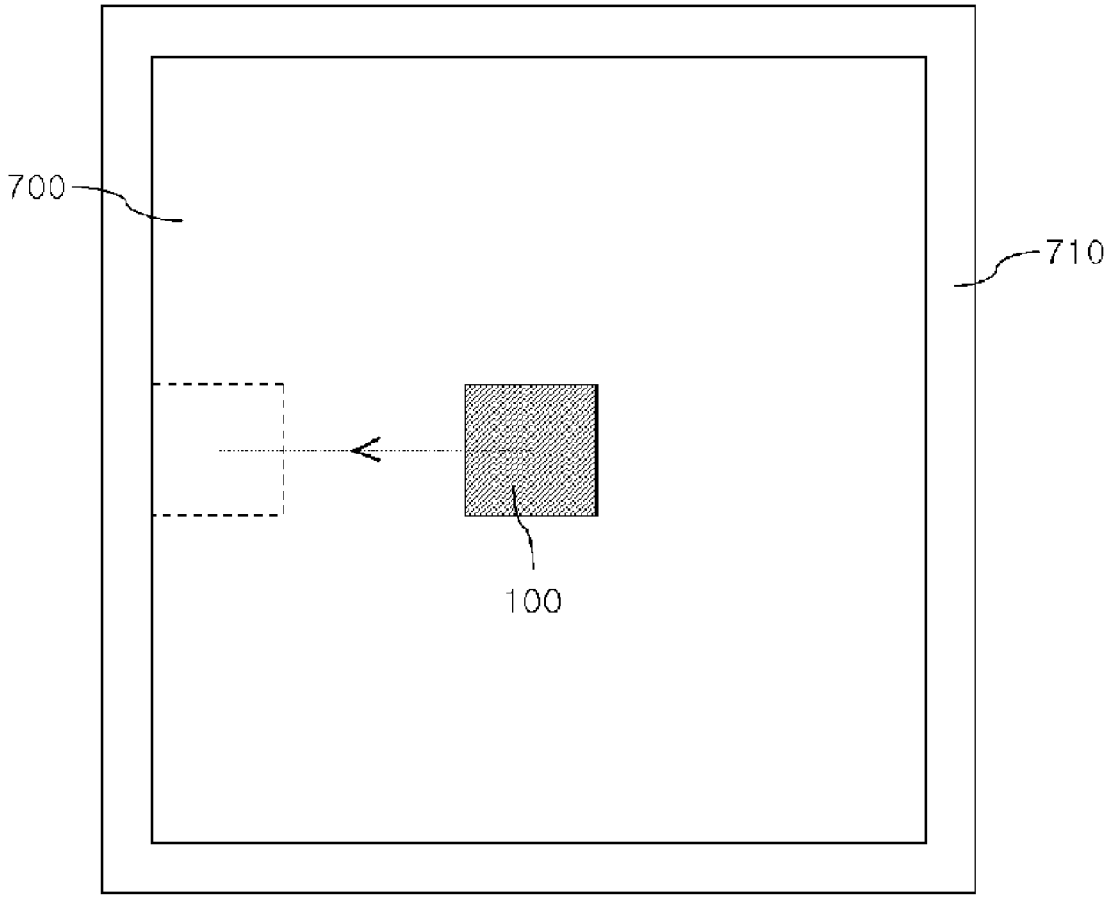

Referring to FIG. 36, when the initial attached position of the window cleaning apparatus is defined at the left side of the window 700, the first cleaning unit 100 may be horizontally moved up to the left end of the window 700 in the left direction.

Referring to FIG. 37, after the first cleaning unit 100 is moved up to the left end of the window 700, the first cleaning unit 100 may be moved in an opposite direction, i.e., the right direction by the certain distance b.

Although the method of controlling the movement of the window cleaning apparatus including the first and second cleaning units 100 and 200 respectively attached on the inner and outer surfaces of the window by the magnetic force is described as an example, the present disclosure is not limited thereto. For example, the method may be applied to a window cleaning apparatus which is attached to one surface of the inner and outer surfaces of the window 700 or a window cleaning apparatus attached to the window 700 through vacuum absorption except for the magnetic force.

According to another embodiment, the second cleaning unit 200 attached to the outer surface as well as the first cleaning apparatus attached to the inner surface of the window may include the buffer member, e.g., a bumper.

For example, when a shock is applied to the second cleaning unit 200 in a state where a shock is not detected at the bumper of the first cleaning unit 100, the first cleaning unit 100 may be continuously moved to separate the first and second cleaning units 100 and 200 from each other.

Thus, when a shock is detected at the bumper of the second cleaning unit 200 in the state where the shock is not detected at the bumper of the first cleaning unit 100, the movement of the first may be stopped to prevent the first and second cleaning units 100 and 200 from being separated from each other.

According to an embodiment, when the window is cleaned using the internal and external cleaning units attached to the inner and outer surfaces of the window using the magnetic force and moved together with each other, the magnetic force between the internal and external cleaning units may be detected to adjust a magnetic force of the magnetic body disposed on the cleaning unit according to the detected magnetic force.

Thus, since the internal and external modules may be attached using the magnetic force adequate for the thickness of the window and the operation process of the apparatus and be moved, the performance and stability of the window cleaning apparatus may be improved.

According to another embodiment, since the moving path of the window cleaning apparatus may be decided on the basis of the width of the window, windows having various widths may be efficiently cleaned.

According to another embodiment, since the window cleaning apparatus is moved at a position adjacent to the initial attached position after the cleaning is finished, the user may easily separate the window cleaning apparatus from the window.

Specifically, when the window cleaning apparatus includes two cleaning units respectively attached to the inner and outer surfaces of the window, the two units may be easily separated from each other to improve the stability of the window cleaning apparatus.

Also, the method for controlling the window cleaning apparatus according to the embodiments may be programmed to be executed in a computer and stored in a computer readable recording medium. Examples of the computer readable recording medium include read-only memory (ROM), random-access memory (RAM), CD-ROMs, magnetic tapes, floppy disks, optical data storage devices, and carrier waves (such as data transmission through the Internet).

The computer readable recording medium may also be distributed over network coupled computer systems so that the computer readable code is stored and executed in a distributed fashion. Also, functional programs, codes, and code segments for realizing the control method can be easily construed by programmers skilled in the art to which the invention pertains.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A window cleaning apparatus comprising first and second cleaning units which are respectively attached on opposite surfaces of a window using a magnetic force to move together with each other, the window cleaning apparatus comprising:

a first magnetic module provided in the first cleaning unit;

a second magnetic module provided in the second cleaning unit;

a magnetic force detection part for detecting a magnetic force between the first and second magnetic modules; and a magnetic force control part for controlling the magnetic force between the first and second magnetic modules, wherein the magnetic force control part is disposed on the first cleaning unit, the magnetic force detecting part is disposed on the second cleaning unit, and a value of the magnetic force measured by the magnetic force detection part of the second cleaning unit is wirelessly transmitted into the first cleaning unit.

2. The window cleaning apparatus according to claim 1, wherein the magnetic force control part decreases the magnetic force between the first and second magnetic modules when the detected magnetic force is greater than a reference value and increases the magnetic force between the first and second magnetic modules when the detected magnetic force is less than the reference value.

3. The window cleaning apparatus according to claim 1, wherein the magnetic force control part adjusts a distance between the first and second magnetic modules.

4. The window cleaning apparatus according to claim 3, wherein the magnetic force control part further comprises a module driving part for rising or falling at least one of the first and second magnetic modules.

5. The window cleaning apparatus according to claim 1, wherein at least one of the first and second magnetic modules comprises an electromagnet, and the magnetic force control part controls an amount of current supplied into the electromagnet.

6. The window cleaning apparatus according to claim 1, further comprising a display part for displaying an intensity of the detected magnetic force.

7. The window cleaning apparatus according to claim 1, wherein the magnetic force control part increases the magnetic force between the first and second magnetic modules using the magnetic force detected by the magnetic force detection part when the first and second cleaning units are attached to the window.

8. The window cleaning apparatus according to claim 1, wherein the magnetic force control part decreases the magnetic force between the first and second magnetic modules using the magnetic force detected by the magnetic force detection part when the first and second cleaning units are attached to the window.

9. The window cleaning apparatus according to claim 1, wherein a moving path of the window cleaning apparatus is decided on the basis of a width of the window.

10. The window cleaning apparatus according to claim 9, wherein, when the window has a width greater than a reference value, the moving path comprises a right downward section in which the window cleaning apparatus is moved downward in a right direction, a left downward section in which the window cleaning apparatus is moved downward in a left direction, and an upward section in which the window cleaning apparatus is moved upward in one direction of right and left directions.

11. The window cleaning apparatus according to claim 1, wherein, when cleaning is finished, the window cleaning apparatus is moved to a position of left and right ends of the window adjacent to an initial attached position thereof.

* * * * *